US009677243B2

(12) United States Patent
Carroll, Jr.

(10) Patent No.: US 9,677,243 B2
(45) Date of Patent: Jun. 13, 2017

(54) CORRUGATED RETENTION AND FILTRATION SYSTEMS FOR SEDIMENTATION CONTROL

(71) Applicant: Robert G. Carroll, Jr., Fayetteville, GA (US)

(72) Inventor: Robert G. Carroll, Jr., Fayetteville, GA (US)

( * ) Notice: Subject to any disclaimer, the term of this patent is extended or adjusted under 35 U.S.C. 154(b) by 0 days.

(21) Appl. No.: 14/845,353

(22) Filed: Sep. 4, 2015

(65) Prior Publication Data

US 2016/0069034 A1 Mar. 10, 2016

Related U.S. Application Data

(60) Provisional application No. 62/070,891, filed on Sep. 8, 2014.

(51) Int. Cl.
*E02D 17/20* (2006.01)
*E02B 3/12* (2006.01)

(52) U.S. Cl.
CPC ..... *E02D 17/202* (2013.01); *E02B 3/122* (2013.01)

(58) Field of Classification Search
USPC ..... 405/15, 16, 32, 52, 302.4, 302.6, 302.7; 256/12.5, 45; 160/84.04, 135, 351, 352
See application file for complete search history.

(56) References Cited

U.S. PATENT DOCUMENTS 4,526,347 A * 7/1985 McLoughlin ..... E01F 13/022 245/5
5,255,997 A * 10/1993 Bailey ..... E02B 3/04 405/15
2013/0108368 A1* 5/2013 Bishop ..... B63G 9/04 405/63

OTHER PUBLICATIONS

BMP Testing for Erosion and Sediment Control; Final Report; dated Oct. 2012 submitted by TRI/Environment, Inc.; 9 pages.

* cited by examiner

*Primary Examiner* — Sean Andrish
(74) *Attorney, Agent, or Firm* — John H Thomas, P.C.

(57) ABSTRACT

This invention is directed to corrugated retention and filtration systems which are designed and installed to control sediment runoff. The corrugated systems creates a multiple of adjacent retention and filtration wedges with acute angles at their downstream vertexes for increased surface area and an increased number of structural support elements throughout the system. The corrugated retention and filtration system provides structural, hydrodynamic, and filtration features not available from a conventional linear systems used for sedimentation control applications.

14 Claims, 18 Drawing Sheets

CORRUGATED RETENTION AND FILTRATION SYSTEMS FOR SEDIMENTATION CONTROL

This filing claims the benefit of U.S. Provisional Patent Application Ser. No. 62/070,891, filed Sep. 8, 2014, incorporated by reference herein in its entirety.

The present invention is directed to corrugated retention and filtration systems and methods of installation in order to control sediment runoff.

BACKGROUND

The term filtration is often considered the primary function of a geotextile used in subsurface drainage applications and for erosion control beneath hard armor along inland waterways and in coastal erosion control systems. In all these cases, geotextiles are used to retain soil particles in-place and prevent their movement caused by the erosive force of seepage exiting from the subgrade, or the traction of overland flow against particles on a ground surface, or the impact of wave action on a ground surface. Prior to geotextiles, graded aggregate filters were the conventional engineering design solution to soil retention. But despite being the conventional solution, the frequency of use for a properly designed and installed graded aggregate filter was very limited due to availability, and costs of materials and/or installation.

The real functions of the filter media are retention and seepage, i.e., to hold the particles in place while seepage exits a soil mass. The required gradation of a graded aggregate filter to provide these functions is a fine pore structure adequate to retain soil particles in place while allowing the free seepage of water as it exits the soil mass without a buildup of hydrostatic pressure at the soil-granular filter interface. If seepage is blocked, hydrostatic pressure will build between the soil particles, reduce their interface friction, and weaken the stability of the soil mass (e.g., subgrade, foundation, or earth slope). The result will be an unstable soil mass and possible failure under the loads being supported by that soil mass.

A geotextile filter must meet the same retention and seepage functions as a graded aggregate filter. When the proper geotextile is specified and installed, it easily provides in-place particle retention to the adjacent soil particles, and the geotextile pores allow seepage to exit freely from the soil mass. This retention of soil particles and seepage of moisture from the soil mass allows for the unrestricted release of hydrostatic pressure from within the soil structure. Both the availability and simplicity of installation for a geotextile make it the preferred filter medium for filtration in subsurface drainage and erosion control applications when compared to the cost of a properly designed and installed conventional graded aggregate filters.

In some cases, voids or openings in the soil mass develop between the soil surface and the filter medium, especially when geotextiles are used. Under these circumstances, subsurface erosion can develop at the soil surface that is not restrained by the filter. If the soil particles are coarser than the geotextile pore structure then the geotextile will actually filter or retain the eroded particles from the fluid as it tries to permeate through the geotextile. These voids in the soil-fabric interface are typically a result of poor soil surface preparation or inadequate compaction before or immediately following placement of the geotextile adjacent to it. These circumstances require remedial actions to prevent long term subgrade or foundation instability problems.

Geotextiles used for subsurface drainage and erosion control are typically nonwoven and/or woven monofilament fabrics with a pore size slightly smaller than the average particle size within the soil mass being retained, and geotextile permeability is significantly greater than that of the soil being protected.

Sedimentation control applications use a geotextile to provide the functions of retention and filtration of eroded particles from a sediment laden fluid as it runs off a freshly graded construction site. The runoff is traveling under gravity flow conditions until the fabric filter mounted on its vertical structure (e.g., silt fence) retains the slurry of soil and water. Once retained, the slurry enters a steady state condition and the solid particles either settle out of suspension to the ground upstream of the vertical structure, or are filtered from the retained slurry as its carrier fluid seeps through the pores of the filter medium. Despite the reference to retention and filtration by the geotextile for sediment control, the fabric functions and the geotextile properties required are significantly different from those for subsurface drainage and erosion control beneath hard armor.

In sedimentation control the geotextile is used as a permeable barrier to span the flow path of a sediment laden fluid. A vertical structure or vertical support elements support the geotextile upright while the fabric provides retention of the sediment laden fluid, allowing the sediments to settle from suspension. Soil particles that remain in suspension upstream of the geotextile are filtered from the retained sediment laden fluid as its water seeps slowly through the fabric pore structure. These conventional structures are referred to herein as linear retention and filtration systems and include silt fences, curb inlet sediment filters, and temporary check dams.

The most visible to the public eye of linear retention and filtration systems is the silt fence, seen around most all earthwork construction sites in the U.S. Their prominence is a result of EPA regulations enacted in 1972 mandating the use of sediment control measures to contain sediment runoff and prevent contamination to adjacent properties, streams, and waterways. In 1975 the EPA approved the use of a geotextile lined fence to meet these regulations, and since then the use and prominence of geotextile silt fences have become one of the standards of practice in earth work construction.

These original EPA regulations have been adopted by other governing bodies on federal, state and local levels, and today each has its own version of those same regulations. Most of the regulatory requirements include detailed specifications for the sediment control structure, the geotextile used for retention and filtration in the system, the structural components of the system, and specific details regarding installation of each of the systems components.

The silt fence is a linear system that is basically a two dimensional structure of specified length and height with the geotextile installed in a vertical posture above ground to provide a retention and filtration barrier for sediment runoff. The silt fence is held vertical by metal or wooden fence posts driven firmly into the ground at nominal spacings (e.g.: 4 to 10 feet). A wire mesh is often secured to the posts before the geotextile to hold the fabric vertical and give it added strength and stability to support the loads from the sediment laden fluid it retains. The bottom of the fabric is buried into the ground (i.e., toe-in) with the backfill firmly compacted into the fabric toe-in trench to prevent erosion and washout of the toe-in and subsequent erosion beneath the system. The geotextile on the structure retains sediment laden runoff resulting from rainfall events. The suspended sediments in the retained runoff either settle to the ground or are filtered out as carrier fluid seeps very slowly through the geotextile filter media. The filtration process described above prevents sediment contamination downstream.

Constant seepage through the geotextile is necessary for filtration of the sediment laden fluid that the system retains. When the retained flow carries sediments in suspension, the geotextile will begin the retention and filtration process, and a filter cake of particles from the sediment laden fluid forms on the fabric upstream surface. The porosity and permeability of the filter cake decrease with time and the eventual result is a retention system with very low to no measurable seepage passing through it. This creates an above ground sediment pond. Inadequate seepage rate through the filter cake can lead to excess buildup of retained sediment laden fluid followed by system failures due to overflow or collapse caused by the lateral forces from the retained fluid upstream of the retention structure (e.g., silt fence).

Proper attention must be given to burial and compaction of backfill at the toe-in of the filter medium at the base of above ground retention and filtration system. Weakened condition of toe-in backfill atop the geotextile at the base of a retention and filtration system due to inadequate compaction or saturation of the soil backfill can lead to further reduced backfill density due to prolonged ponding of retained sediment laden fluid upstream of the silt fence.

These toe-in problems will result in localized system failures due to scouring and erosive channels under-cutting the fabric at its toe-in at the base of the retention and filtration system. These types of failure can progress to more complete system failures if not corrected in time.

SUMMARY

Accordingly, it is object of the present invention to overcome the drawbacks of the foregoing, prior art retention and filtration systems. The function of retention and filtration are improved with the use of a corrugated filter system.

In one example, a corrugated retention and filtration system comprises a plurality of three or more vertical support posts adapted to be mounted partly in-ground and having a portion of the posts extending generally vertically above-ground. A web of porous filter fabric is connected to each vertical support post and forms a panel of filter fabric between each next adjacent pair of vertical support posts. Each filter fabric panel has a length that is substantially equal to a distance between vertical support posts. Each vertical support post has a top portion proximate an end of the post that is above-ground. A first spacer cord is fixedly attached to every second adjacent top portion of the vertical support posts with the first spacer cord having a cord length. The first spacer cord length is less than the sum of the lengths of adjacent fabric filter panels between the support posts attached to the first spacer cord. A second spacer cord may be fixedly attached to the second adjacent top portion of the vertical support posts that are not attached to the first spacer cord. Each adjacent filter fabric panel may have substantially the same length. The adjacent filter fabric panels define an angle there between with the vertex of the angle being the vertical support post positioned between the adjacent filter fabric panels. The angle formed by adjacent filter fabric panels can be an acute angle. The length of the first spacer cord between every second adjacent vertical support post can be substantially the same, and the length of the second spacer cord between every other second adjacent vertical support post can be substantially the same.

In another example, a method of erecting a corrugated retention and filtration system on a work site comprises several steps. First, a web of porous filter fabric connected to a plurality of three or more vertical support posts is provided, wherein the web forms filter fabric panels between each next adjacent pair of vertical support posts. Further, each filter fabric panel has a length that is substantially equal to a distance between vertical support posts. The next step is fixing the vertical support posts into the ground at a work site wherein adjacent filter fabric panels between the vertical support posts form an angle there between. A first spacer cord is provided and attached to a top portion of every second adjacent vertical support post, wherein the first spacer cord length is less than the sum of the lengths of adjacent fabric filter panels between the support posts attached to the first spacer cord.

DETAILED DESCRIPTION

Figure 1A:
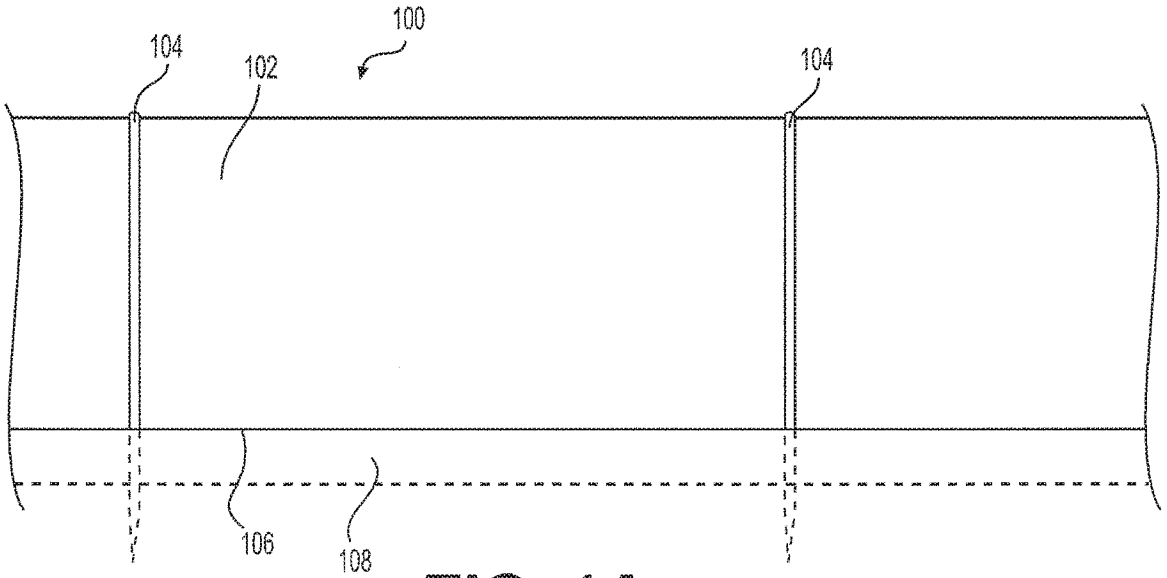
FIG. 1A PRIOR ART
FIG. 1A is a front view of a linear retention and filtration system (e.g., conventional silt fence system.)

The present invention is directed to corrugated retention and filtration systems used to stop the passage of sediment laden fluids that are traveling by gravity flow from exiting beyond established boundaries. The system retains the sediment laden fluids upstream of the system, allowing particles to settle from suspension to the ground. The system also filters the solid particles from the retained sediment laden fluid as it permeates through the system and passes freely downstream Corrugated retention and filtration systems have multiple applications including, but not limited to the trouble areas of a linear silt fence system prone washouts, over flow or knock down due to excess flow into the linear system. Curb and drop inlet protection systems for collection of storm water runoff and submerged turbidity barriers are some of the many other applications for corrugated retention and filtration systems.

The corrugated retention and filtration systems described herein provide structural, hydrodynamic, and filtration features not available from conventional linear systems used for sedimentation control applications. The corrugated system creates a multiple of adjacent retention and filtration wedges that provide increased surface area and an increased number of structural support elements adjacent to the sediment laden fluid that is retained by the system.

The corrugated retention and filtration wedge design creates an increased surface area of the filter medium adjacent to the retained sediment laden fluid. More surface area adjacent to the retained sediment laden fluid creates a more rapid rate of filtered seepage for the fluid permeating through the corrugated system when compared to the filtered seepage through a linear system spanning the same flow path. Through the use of increased surface area of the filter media, the hydrodynamic benefits of a corrugated retention and filtration wedge design, and an increase in structural elements within the system, improved filtered seepage performance and structural stability is obtained in the corrugated systems discussed herein.

A component of the corrugated system described herein is the use of adjacent wedges of filter fabric panels. These wedges are used and may be described in comparison with prior art linear filtration systems. The wedges have narrow or acute angles formed by the adjacent filter panels. Significant benefits in this corrugated structure include a series of adjacent wedges that span a flow path of a sediment laden fluid. For example, equal acute vertex wedges provide superior retention, filtration, and seepage performance versus existing linear systems.

These wedges are described, in one example, in a silt fence system. The following Table 1 provides a comparison of the structural components for a linear silt fence system versus three alternative corrugated systems in which the wedges fit adjacent to one another to span the same flow path of sediment runoff as a segment of the linear system. In Table 1, the linear system includes a total length of ten feet with vertical support members at each end and at the midpoint between the two ends. The filter fabric height is three feet above ground level. Note that the examples in this table are used for illustration purposes only, to compare the differences between a linear system and three different corrugated systems.

TABLE 1

Examples of Linear and Corrugated Retention and Filtration Systems
Height (H)of Filter Fabric = 3' Above Ground
SYSTEM ELEMENTS & DIMENSIONS

| Example System | Wedge(s) Vertex Angle (Degrees) | Number of Vertical Support Posts | Number of Filter Fabric Panels | Total Length of Each Individual Filter Fabric Panel | Total Length (L) of All Filter Fabric Panels in Designated System (ft) | Area of Filter Fabric in Designated System (L × H) ($ft^2$) |
|---|---|---|---|---|---|---|
| Linear System | 0 | 3 | 2 | 5.00 | 10.00 | 30.00 |
| Corrugated System (1) | 89 | 3 | 2 | 7.07 | 14.14 | 42.42 |
| Corrugated System (2) | 52 | 5 | 4 | 5.60 | 22.40 | 67.20 |
| Corrugated System (3) | 37 | 7 | 6 | 5.27 | 31.62 | 94.86 |

As is readily apparent in the foregoing examples, the vertex angle in each of the wedge components defines an acute angle. For the purposes of the present corrugated systems, the vertex angle of each filter wedge component may be any acute angle from zero to 90 degrees. Wedge vertex angles of greater than 90 degrees define obtuse angles and impart less of the benefits of the corrugated systems described herein.

Special system features such as aprons connected to the vertical filter medium of the corrugated system provide significant latitude in the design and installation options for vertexes used in the corrugated system. For example, without the apron in the corrugated system, toe-in at the base of the corrugated system is limited to larger acute angles (greater than about 30 degrees). With the apron, the vertexes can approach very small acute angles. Still there are practical limits to tight vertexes that may limit installation feasibility. Typically the wedge vertex angle may range from about 90 degrees to about 30 degrees. Still further alternatively, the wedge vertex angle may range from about 90 degrees to about 45 degrees. As would be appreciated, the above table defines wedge vertex angles where the number of wedges is a whole number increment within the same straight length that a linear span might conventionally cover. Needless to say, the wedge vertex angle may be varied so that there could be more or fewer wedges within the distance between a comparable alternative linear filter system. Also, the length of the filter fabric panels between adjacent vertical support posts may be varied to form a deeper or shallower wedge which would result in different vertex angles for those wedges.

The corrugated structure provides enhanced lateral load support when the upstream vertical support elements resist the lateral load applied to the downstream vertical support elements and throughout the length of filter medium that spans from the upstream to the downstream vertical support elements. This lateral load support is more pronounced when vertex angles are smaller in the system.

This enhanced lateral load support is magnified by the fact of a greater number of vertical support elements provided by a corrugated retention and filtration system than are provided by a linear retention and filtration system (e.g., conventional silt fence) when both are spanning the same flow path of sediment runoff Also, the upstream vertex angles of the corrugated retention and filtration system facing the approaching sediment laden fluid flow deflect the force of the fluid flow by that angle. And the flow passes laterally over the face of the filter fabric, rather than having a blunt impact on the system structure.

The numerous adjacent vertical support elements and attached filter medium lend lateral load support to the whole system when the retained sediment laden fluid reaches its static state. While in a static state, the fluid seeps through the filter medium and the solid particles in suspension are filtered out and retained on the filter medium upstream side.

The performance of filtration of sediment laden fluids is enhanced in at least several specific ways.

First, a corrugated structure provides a much greater rate of filtered seepage for a sediment laden fluid that it retains across a given flow path than a linear system is capable of when spanning an identical flow path. And the corrugated system provides equivalent filtration efficiency of particulate matter from the sediment laden fluid that it retains and filters, when compared to the filtration efficiency and overall performance of a linear system spanning the same flow path.

Test Number 1

In order to confirm the effectiveness of a filtered seepage rate in a corrugated system, a test flume was constructed to compare the seepage rates of a linear filtration system with a corrugated filtration system. The test flume has a width of about 18 inches. In each test, a soil/water slurry with a test volume of 10 liters includes 50,000 ppm of sediment. In order to replicate a hypothetical sloped project site, the test flume was fixed at a 37 degree angle from the horizontal.

The control system is formed of a straight, single filter fabric panel of approximately 18 inches wide and a total surface area of about 144 square inches. The corrugated system was formed of a single wedge of two panels of filter fabric placed at an acute angle of 74 degrees with respect to each other. Each panel has a length of about 15 inches for a total of 240 square inches of the wedge system.

The soil/water slurry was applied to each sample filter system. After one hour, the linear filter system had drained approximately 3.3 liters of the total 10 liters. The corrugated filtration system had filtered approximately 6.7 liters of the sediment fluid. The linear filtration system did not achieve complete drainage until more than 4 hours had passed. The corrugated system was completely drained at approximately 74 minutes. The filtered fluid was analyzed in both example cases, and in each example, the filtered fluid contained approximately the same amount of residual sediment in the filtered water. Accordingly, it is readily apparent that the corrugated system as demonstrated by even just a single filter wedge is a significantly more efficient filter than the linear control sample.

In a second performance enhancement, the upstream vertexes of a corrugated system created by upstream vertical support elements deflect the force of sediment laden fluid flowing into its system rather than taking the blunt impact of the force from the sediment laden fluid striking it head-on, as does the surface area of a linear system which is perpendicular to the direction of the sediment laden fluid flow that impacts and is retained by its structure.

Third, a corrugated structure provides more uniform division and distribution of the sediment laden fluid across the full width of the flow path spanned by the system and thereby distributes the increments of sediment laden fluid into a multiple of retention and filtration wedges that span the flow path. As a result the corrugated system (1) reduces the quantity of and impact from unfiltered sediment laden fluid entering the system and making contact with the individual elements of the system; (2) promotes faster filtered seepage of the retained sediment laden fluid through the system; (3) reduces the stresses and forces acting on the individual elements of the system and their support structure, and (4) isolates any potential localized failure conditions to the individual retention and filtration wedges where the failure condition exists rather than allowing the failure to propagate all along the systems width as would occur with a linear retention and filtration system, e.g., a conventional silt fence system.

Fourth, the upstream vertical support elements of the corrugated system provide lateral load support to their adjacent downstream vertical support elements and the retention-filtration-seepage medium that spans between the vertical support elements. This lateral load support is transmitted from the vertical support elements through the filter fabric panels (and through the filter fabric panel support structure when one is used) to the downstream vertical support element throughout the corrugated system structure wherein upstream vertical support elements are connected to downstream vertical support elements by segments of the system filter fabric panel medium. This lateral load support makes the corrugated system able to support more load from the sediment laden fluid it retains within the flow path spanned by the system than a linear system spanning the same flow path. As a result of the lateral load support, the corrugated system is a more structurally stable system, able to resist greater forces, support more load, and is therefore be less prone to failure due to collapse and/or overturning under lateral load from the sediment laden fluid that contacts it, than a linear system.

Also, the corrugated geometry of the system structure creates an acute angular alignment of the system filter fabric panels to the direction of sediment laden fluid flow entering the system. The filter fabric panel alignment forces the sediment laden fluid from each flow event to traverse along the surface of the filter medium. This lateral flow washes against the particles retained by the filter during the previous retention-filtration-seepage event. The result is a cleansing of the filter cake that was formed on the upstream surface of the system's filtration medium during a previous retention-filtration-seepage event. This filter cake cleansing rejuvenates the rate of filtered seepage through the corrugated system to a much faster seepage rate through the filter than it was capable of at the end of its previous retention-filtration-seepage event when the filter cake was originally formed and/or built on top of.

The performance features described above are enhanced in one example by using acute vertexes and uniform lengths of filter fabric panels throughout each system design. Each corrugated retention and filtration system should be accompanied by system design, material specifications, and installation criteria required to assure proper system construction and performance. Included in the corrugated filter design are the selections of system components (e.g., filter medium, vertical support elements, and support mesh if any is used), preferred acute vertex angles of each filter wedge, and filter fabric panel dimensions. A project may require more than one corrugated filter design to deal with special problems encountered at various locations on the project site. These variations to system design should be highlighted to assure proper treatment in specific locations.

Retention and filtration are the primary functions of all corrugated retention and filtration systems. For most applications the system components (e.g., filter medium or geotextile) will be specified for compliance to regulatory agencies requirements. Some applications may sacrifice filtration efficiency to assure adequate outflow from the sediment laden fluid through a system. In these specific instances of sedimentation control, and for other applications not related to environmental regulations, the design parameters and components-specified for a corrugated retention and filtration system can be engineered into the system design to accomplish a targeted range of retention or passage.

The parameters required for each system (or segment of system) are typically based on the performance mandated by regulatory requirements. Minimum filter fabric specifications and materials are discussed in American Society for Testing and Materials (ASTM) D 6461-99, Standard Specification for Silt Fence Materials, incorporated by reference herein. While the foregoing specification discusses silt fences specifically, the same or similar filter fabric materials could be deployed in curb and drop inlet protection systems and submerged turbidity barriers as well.

The filter medium specified for a corrugated retention and filtration system may vary significantly depending on the size and distribution of the particles to be retained and filtered by the system. And this in turn may vary based on the application, the field conditions, the performance, and the specification requirements. One structure may demand a fine particle size distribution to be retained and filtered from sediment runoff, while another may need a very coarse uniform particle size to be retained, in which case a dense filter cake is not likely to form on the filter surface.

Another system may be retaining debris and trash in the storm water runoff instead of or in addition to finer sediment particles. In this last case, a coarse mesh may be used alone or in conjunction with a geotextile to provide the filtration function desired of the system.

The filter medium of the system retention and filtration wedges may be separate, cut fabric sections or segments (also referred to as panels) connected at both their ends to a vertical support post. This technique would be used for creating sections of the corrugated system using segmental pieces. This approach may be best suited for installing small segments of a corrugated retention and filtration system to deal with localized problems within a continuous length of a linear retention and filtration system (e.g., silt fence). Alternatively, the filter medium of the system may be in one continuous length that spans the full length of the corrugated retention and filtration system with the filter fabric connected to vertical support posts along the continuous length of the system corrugated structure. A continuous length of filter fabric may also have pockets or sleeves sewn therein that extend the vertical height of the fabric and are open to the top and bottom. The pocket holds a vertical support post therein.

Uniformity and continuity of the three dimensional geometry of a corrugated filter structure is preferred to assure dimensional stability under load, retention and filtration performance capabilities, and to prevent premature system failure.

In one example, a way to improve the uniformity and continuity of the three dimensional geometry of a prefabricated corrugated system segment is discussed in the following in connection with a silt fence system. Prefabricated segments of a corrugated retention and filtration system may also be used in curb inlet, drop inlet, and submerged turbidity curtain applications In the example, a nominal geometry is chosen with respect to the length and height of a filter fabric panel or segment of filter medium. For example, a segment/panel having the dimensions of 3'×3' may be formed. These segments are provided either in individual wedge combinations or two or more wedge combinations. The system is folded in an accordion style whereby next adjacent vertical support posts (every other post) are aligned. Each of these next adjacent support posts may then be attached together with a spacer cord. This cord has a pre-determined length so that when the prefabricated wedge is opened up, it opens up to a specific angle as measured at the vertex where the adjacent filter panels are connected. In a very simple example, the spacer cord may be 3' in length, thereby forming a vertex in the filter wedge of 60°.

The size of the wedges described herein can be discussed in the context of the size of the side filter panels and the size of the acute angle at the downstream vertical support post vertex. The filter fabric panels can have length of approximately 2 feet to approximately 16 feet between adjacent upstream and downstream vertical support posts. Alternatively, the filter fabric panel length can be approximately 3 feet to 10 feet in length. Still further alternatively, the filter fabric panel can have a length of approximately 4 feet to 8 feet. Another way to conceptually discuss the size of the filtration and retention wedges is to discuss the distance between next adjacent upstream vertical support posts. As indicated, this distance is less than the length of the two filter fabric panels that go from the respective upstream vertical support members to the mutually adjacent downstream vertical support posts. This distance between upstream vertical support posts may be approximately 3 feet to 16 feet, or alternatively about 4 feet to 10 feet. Or still further alternatively about to 6 feet to 8 feet. Relatively larger filtration and retention wedges than discussed herein in the context of filter fabric panel length, vertex acute angle, and distance between next adjacent upstream vertical support posts, cannot be as effective as an array of filter wedges of the size described herein.

If it is desired that the corrugated system be engineered to be used in a relatively more aggressive or high sediment laden fluid flow, then a small or tight angle may be used in order to create high surface area of filter fabric. The spacer cord is shortened between posts. As noted earlier, this prefabricated section of filter medium may include a single wedge or two or more wedges. As merely an example, if it is determined that a corrugated retention and filtration system is required for a certain number of feet at a project site, then only a specified number of adjacent prefabricated retention and filtration wedges could be deployed across the specified high fluid flow zone.

Also, while uniformity is often desirable, it is possible that a corrugated retention and filtration system may be asymmetrical and/or non-uniform. In this way, the specific sediment laden fluid flow may be addressed with the custom deployment of various lengths and sizes of filtration fabric wedges and sizes.

Many of the potential installation problems are the same for both a corrugated retention and filtration system and the traditional filtration systems that the corrugated system may be used in conjunction with to resolve traditional sedimentation control problems. The filter medium used in both the corrugated and linear retention and filtration systems is prone to system failures if proper material property specifications and installation procedures for each system are not followed (e.g., ASTM D6461 & D6462 or other proven and acceptable specifications and guidelines). Proper filter (e.g., geotextile) toe-in at the base of the retention system is imperative for both linear and corrugated filters to prevent scour and system failures due to sediment laden fluid flow beneath the structure.

The key factors of filter fabric toe-in that must be met are optimum fabric burial depth, proper filter medium placement into the toe-in trench, the backfill material used and achieving its optimum compacted density of backfill. These are straight forward criteria, but details are often overlooked, and the results are washed out failures of the system.

The angularity or zig-zag alignment of the corrugated retention and filtration system at the ground surface may create toe-in difficulties for the filter fabric at the base of its corrugated structure. These difficulties may present problems achieving proper compaction of the toe-in back fill or burial depth of the filter fabric into the toe-in trench. In order to alleviate these potential toe-in problems, an apron of filter fabric may be connected at the base of the filter fabric that extends from the system's vertical, corrugated structure. The apron can lay horizontally on the ground surface like a blanket. The connection between the vertical filter fabric and the apron or horizontal blanket of fabric that lays atop the ground surface can be achieved via stitch, weld, or other acceptable method of fabric junction. The junction technique and the fabric apron must provide pore structure and junction strength at the seam connecting the vertical and horizontal fabric elements adequate to prevent passage of sediment laden fluid beyond the system prior to being filtered through the system.

The front edge of the apron will lay horizontal on the ground surface and extend beyond the alignment of upstream vertical support elements for the system filter fabric of sufficient length for proper "toe-in". This front edge of the apron should be buried in a toe-in trench located parallel to the upstream alignment of the corrugated system vertical support elements. This toe-in of the apron for the corrugated retention and filtration system should be performed following the relevant standard procedures from ASTM D 6462-03 Standard Practice for Silt Fence Installation.

One of the primary functions of both a linear retention and filtration system (e.g., silt fence) and a corrugated retention and filtration system is to retain sediments upstream of their structures. If functioning properly, sediments will accumulate on their upstream sides. If and when that retained sediment gets near the maximum retention capacity for both a linear and a corrugated retention and filtration system, the excess of retained sediments should be removed and disposed of properly. Routine system observations should be performed and maintenance provided when deemed necessary for either system.

The corrugated retention and filtration system process has numerous applications including those focused on sedimentation control problem areas for silt fences, i.e., at the foot of and in tiers installed on very steep slopes, and at the inflow/outflow passageways or spillways of fluid impoundments. The process for the corrugated retention and filtration system may not be well suited for use in all roadside drainage channels because the typical cross section of a roadside drainage ditch might be too narrow to take advantage of the performance features offered by a multiple of adjacent retention and filtration wedges that form the corrugated retention and filtration system across an overland flow path of sediment laden fluid. It is this multiple of wedges that provide more surface area of filter medium adjacent to the retained sediment laden fluid and more vertical support elements for faster filtered seepage and improved structural stability of the system. The corrugated retention and filtration process may be used to address problem issues in roadside drainage ditches, but only if modifications are made to the dimensions of the flow channel being treated.

Silt Fence Example

The corrugated system will be described in the context of various silt fence constructions illustrated in the attached drawings. At the outset, FIGS. 1-3 demonstrate conventional, known silt fence systems.

Figure 1B:
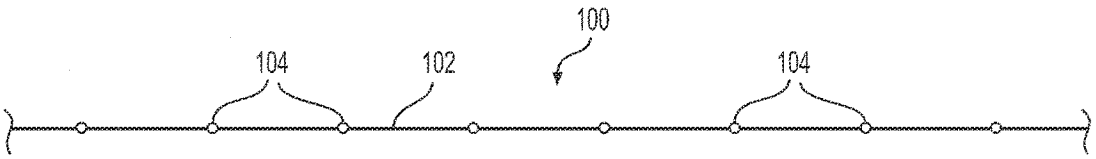
FIG. 1B PRIOR ART
FIG. 1B is a top view of the linear retention and filtration system (e.g., conventional silt fence system) shown in FIG. 1A.
Figure 1C:
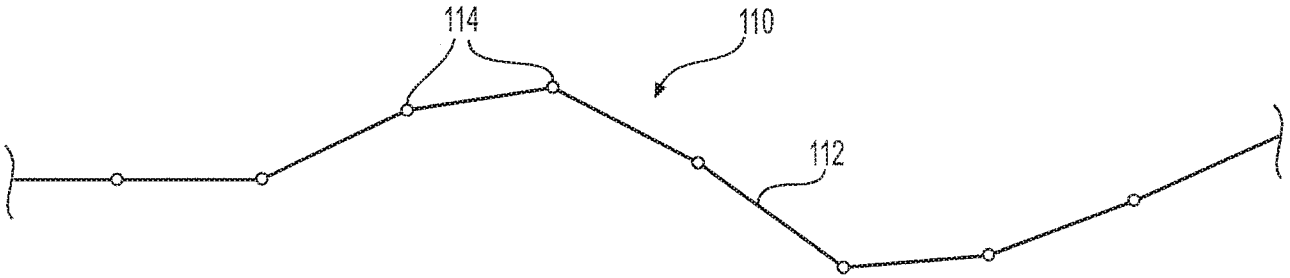
FIG. 1C PRIOR ART
FIG. 1C is a top view of a linear retention and filtration system (e.g., conventional silt fence system) whose straight linear alignment has been disrupted by natural obstacles of terrain, vegetation, large objects, etc. (e.g., bluffs, trees, boulders, etc.) left in place during site work construction.

Turning first to FIG. 1A, there is shown a silt fence 100 made up of vertical support posts 104 and filter fabric 102. The vertical support posts 104 are driven into the ground. Ground level 106 illustrates that the bottom end of the vertical support post 104 is well-planted in the ground. Also, there is an underground portion 108 of the filter fabric 102. This filter fabric portion 108 is often referred as the toe-in portion of the filter fabric so that any water that is running on the ground level 106 will not pass underneath the filter fabric 102 and flow beyond the system without being retained and filtered. This toe-in portion 108 of the filter fabric 102 is well-known and specified with respect to silt fence systems generally. FIG. 1B is a top view of the silt fence 100 also shown in FIG. 1A. The vertical support posts 104 are shown with the filter fabric 102 connected to those posts along the length of the fence 100. FIG. 1C is an aerial view of a silt fence 110 that has deviations from a straight line alignment. The angles shown are due to topographical and physical obstructions that prevent installation from following an exact straight line. The vertical support members 114 are spanned by the filter fabric 112.

Figure 2:
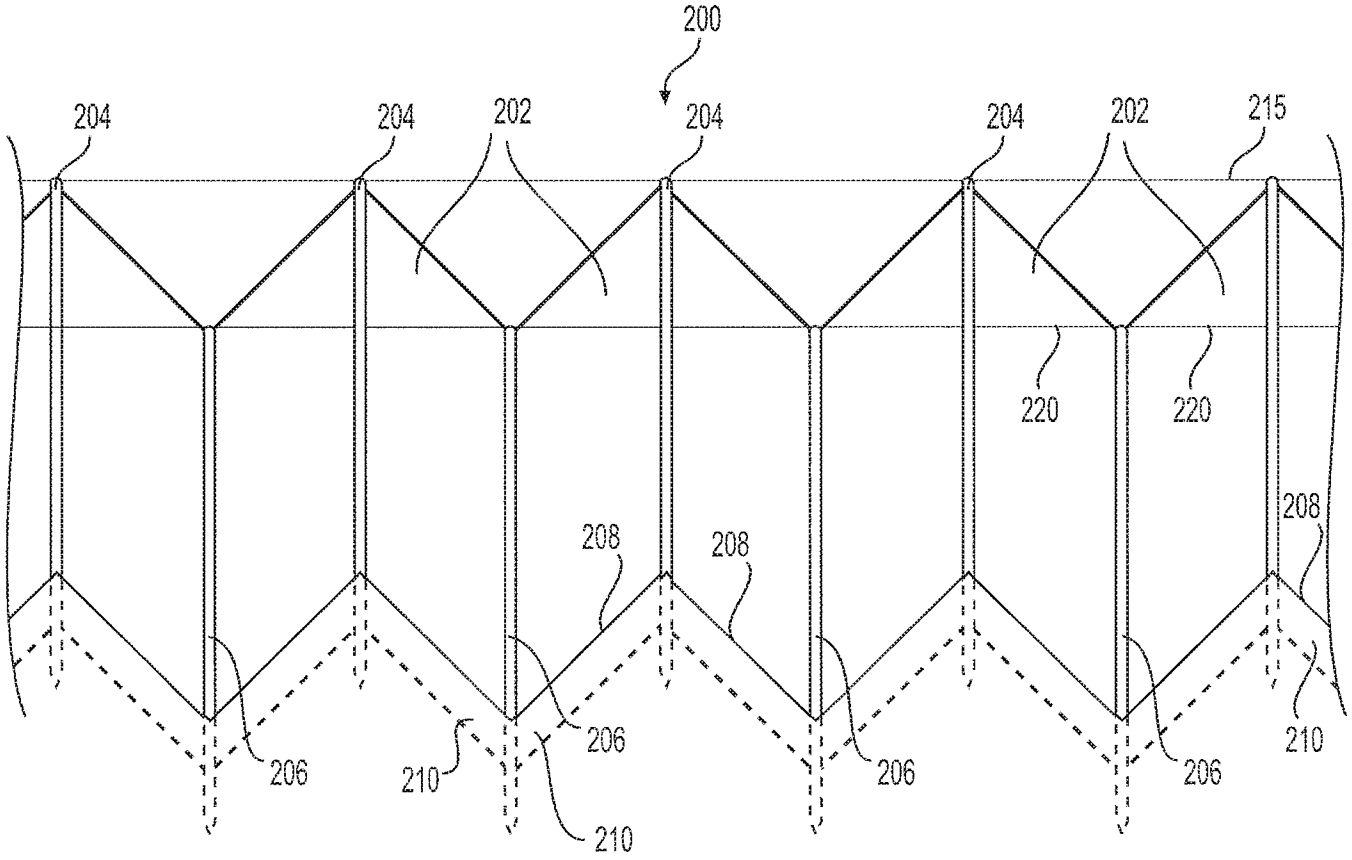
FIG. 2 is a front perspective view of a corrugated retention and filtration system used to resolve conventional silt fence problems as described herein.

FIG. 2 is a perspective view of a segment of a corrugated retention and filtration silt fence 200 that could be used to resolve the problems of scour beneath, overflow and toppling often encountered by a conventional silt fence. In this view, the upstream side of the fence 200 is illustrated. There are upstream vertical support posts 206 and downstream vertical support posts 204. The filter fabric 202 forms filter fabric panels in between each next adjacent pair of vertical support posts, —alternating upstream and downstream vertical support posts 206 and 204. The ground level 208 is shown to illustrate that the vertical support posts 204 and 206 are mounted partly in-ground. Each filter fabric panel 202 has a length that is substantially equal to the distance between next adjacent vertical support posts 204 and 206. Likewise the toe-in portion 210 of the filter fabric panels 202 are shown buried in the ground. The upstream vertical support posts 206, also referred to as second adjacent support posts, are further tethered to each other by means of a spacer cord 220 at the top portion of the support posts. Similarly, the downstream vertical support posts 204, second adjacent support posts, are attached at their top portion by a spacer cord 215. Both spacer cords 215 and 220 are tied off on the tops of the respective next adjacent downstream and upstream vertical support posts 204 and 206 respectively in order to define a predetermined distance between those supports posts. This distance between tethered support posts is less than the sum of the lengths of the filter fabric panels 202 between the support posts attached to the spacer cord 215 and 220. In this way, the angle formed by adjacent filter fabric panels 202 is defined. The adjacent filter fabric panels 202 form wedges where the vertex of the angle is the vertical support post 204 between panels 202 so that there are illustrated adjacent wedges in the silt fence 200. The dimensions of those wedges are predetermined by the length of each filter fabric panel and the length of each segment of spacer cords 215 and 220 that are tied off on the top portion of each vertical support post.

Figure 3:
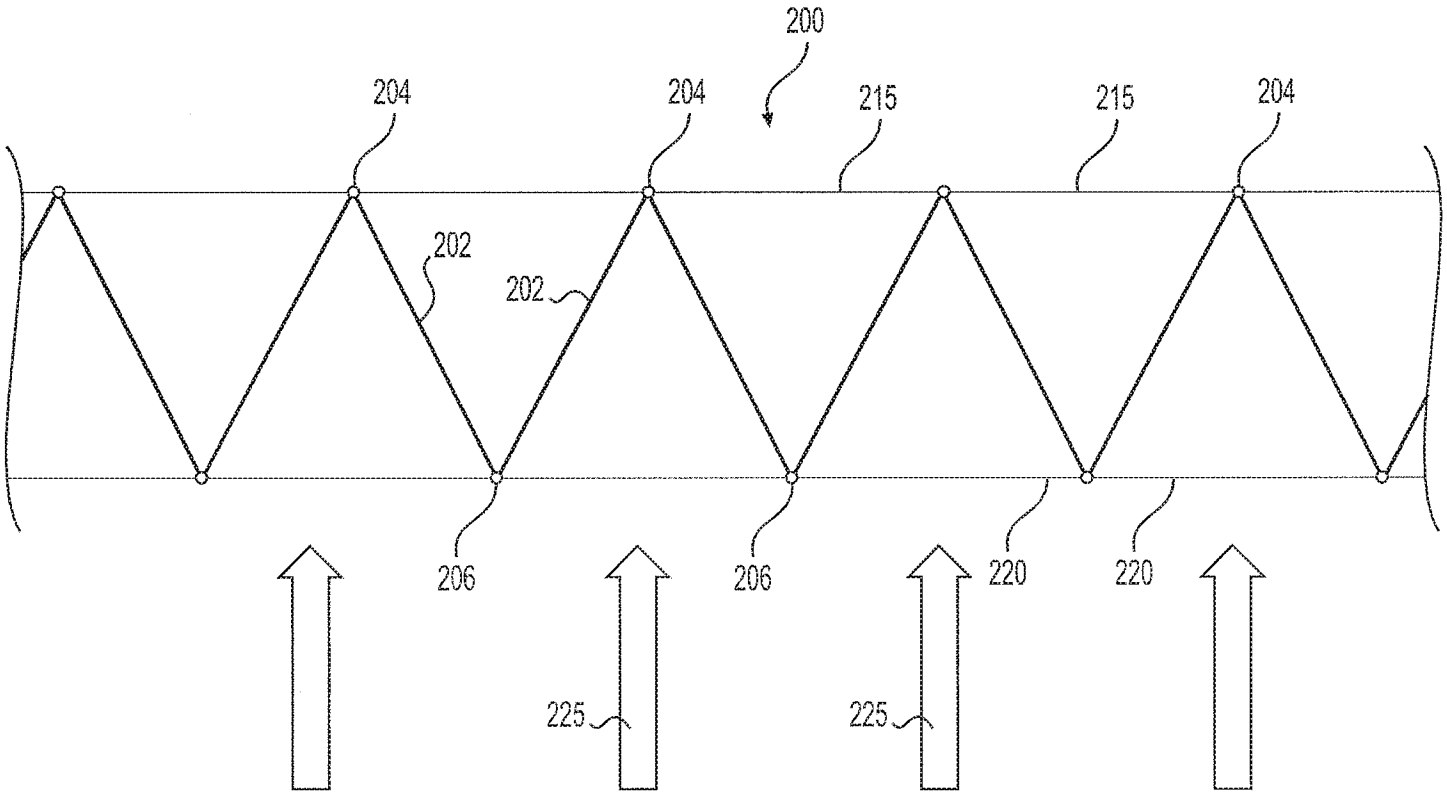
FIG. 3 is a top view of the corrugated retention and filtration system illustrated in FIG. 2.

FIG. 3 is a top view of the silt fence 200 illustrated also in FIG. 2. The water flow arrows 225 illustrate that the upstream vertical support posts 206 and downstream vertical support posts 204 are positioned to capture and retain the flow of water and silt laden liquids. The spacer cords 215 and 220 are similarly illustrated in this FIG. 3. The wedges defined by the adjacent upstream vertical support posts 206 and the filter fabric panels 202 that extend downstream therefrom are all wedges having acute angles as discussed in detail herein.

Figure 4:
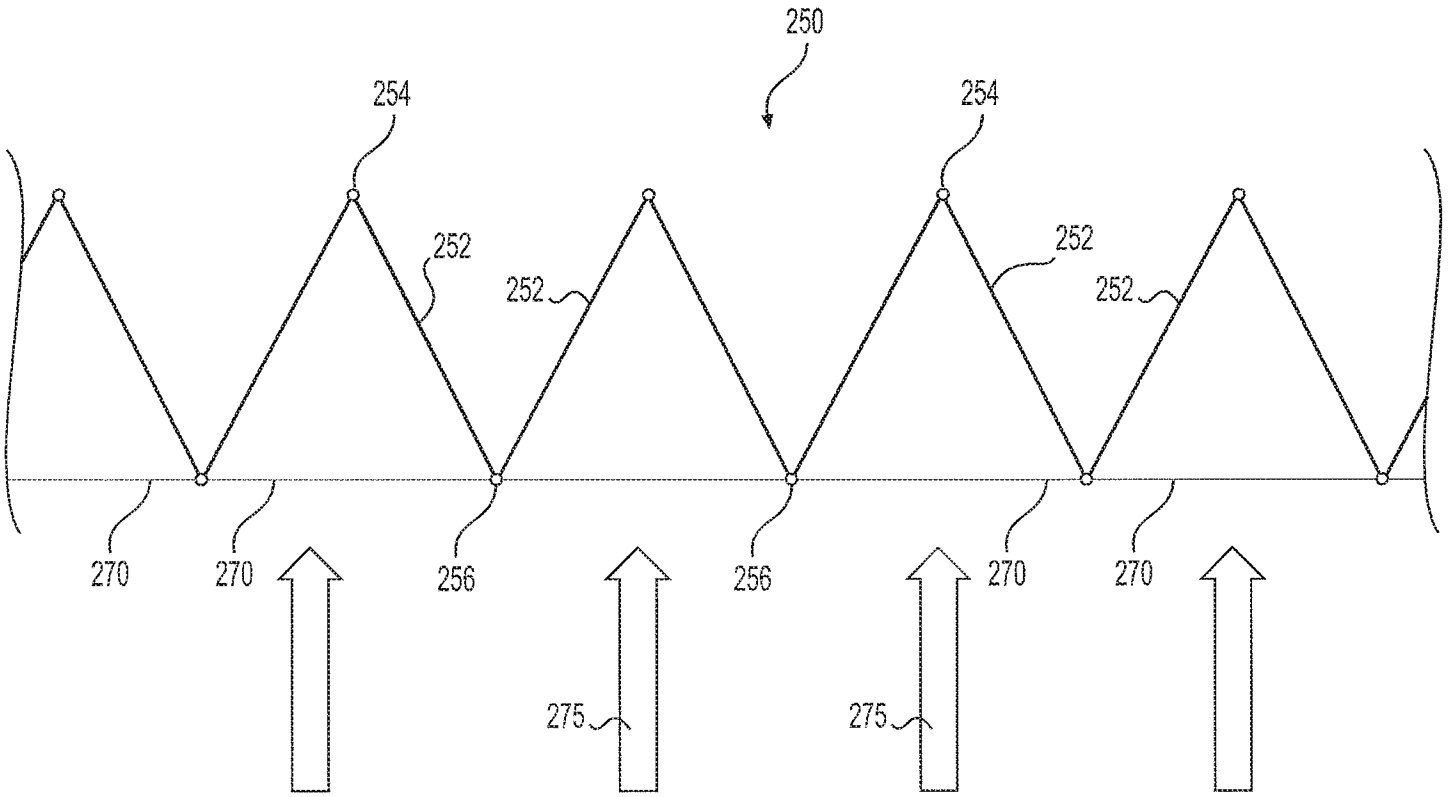
FIG. 4 is an alternative embodiment of the corrugated retention filtration system of FIG. 3.

FIG. 4 is a silt fence system 250 that includes upstream vertical support posts 256 and downstream vertical support posts 254 having filter fabric panels 252 there between. The water flow arrows 275 illustrate where the water and silt laden fluid run into the fence 250. In this example, an upstream spacer cord 270 extends between the upstream vertical support posts 256. There are no downstream spacer cords.

Figure 5:
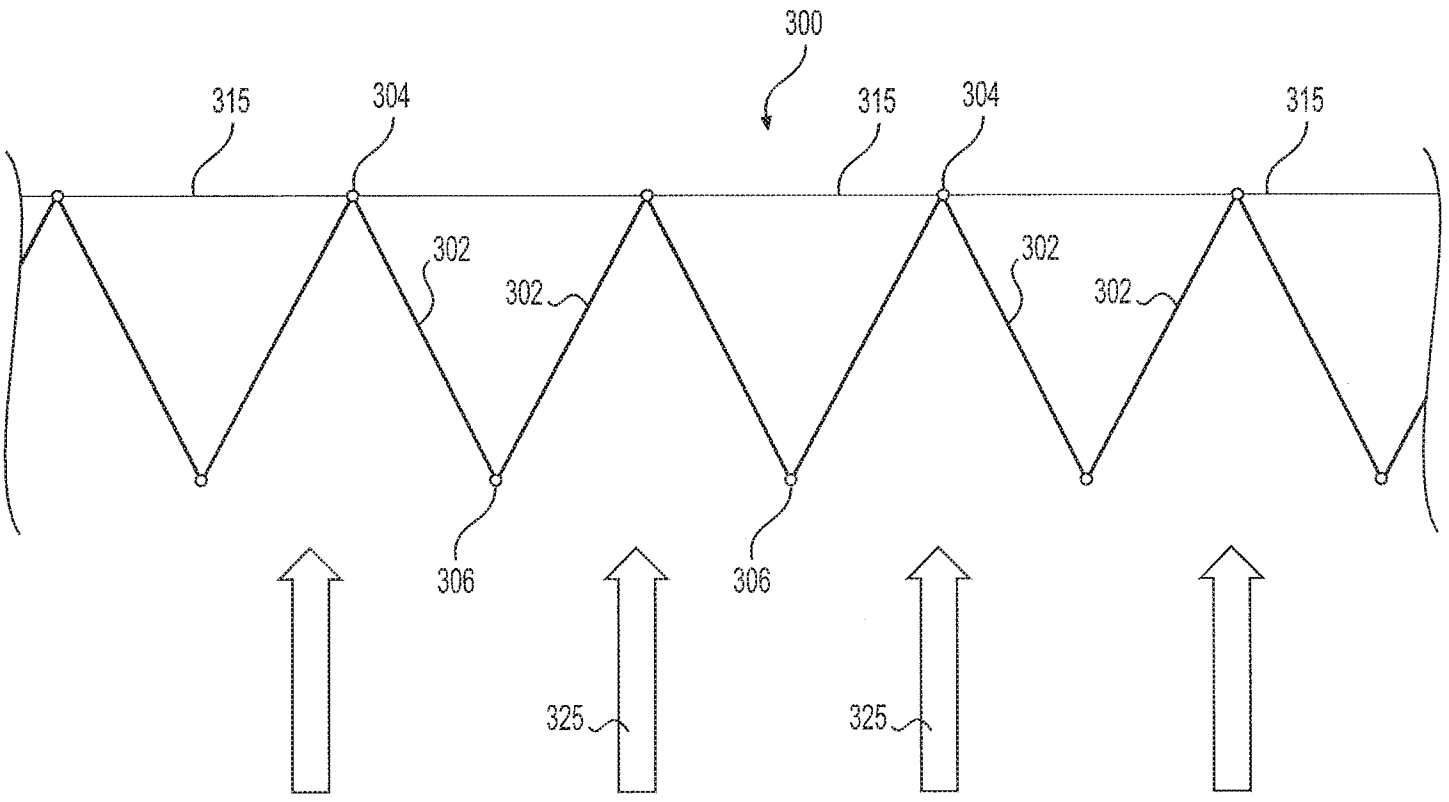
FIG. 5 is a still further example of a corrugated retention filtration silt fence system as shown in FIG. 3.

In FIG. 5, the silt fence system 300 includes the water flow arrows 325, the downstream vertical support posts 304 and upstream vertical support posts 306. Filter fabric panels 302 extend between the respective adjacent upstream and downstream vertical support posts 306 and 304. In this example, only the downstream vertical support posts 304 are connected and tethered by a spacer cord 315. There is no upstream spacer cord in this example.

Turning now to FIGS. 6-11, there are demonstrated alternative geometries of the corrugated retention and filtration silt fences described herein. As will be discussed for example, there may be variations in geometry depending on specific topographical features of a project site in combination with anticipated water and silt flow volumes.

Figure 6:
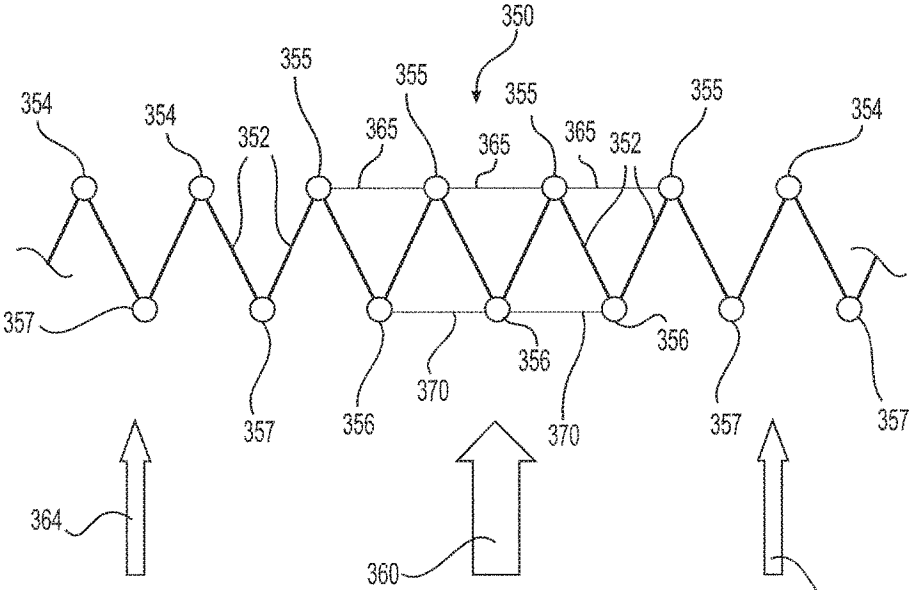
FIGS. 6-11 are top views of alternative corrugated retention and filtration silt fence systems demonstrating alternative geometries to the retention and filtration systems described herein.

FIG. 6 illustrates a top view of a corrugated silt fence 350 that includes spacer cords only along a portion of its length. The water flow arrows 360, 362 and 364 are not equal. This means that the water flow 360 is anticipated to be higher in volume and/or flow rate than the other water flows 362 and 364. In order to reinforce the silt fence 350, spacer cords 365 and 370 are selectively deployed. Specifically, upstream vertical support posts 356 are tethered together by spacer cords 370. Additional upstream vertical support posts 357 are not secured together with any spacer cords. Similarly, downstream support posts 355 are tethered with spacer cords 365. The additional lateral support provided by the spacer cords 365 and 370 give more strength to corrugated retention and filtration system 350 in the water flow path 360. The other downstream vertical support posts 354 are not tethered together. In this example, the filter fabric panels 352 that extend between the respective upstream and downstream support posts are generally equal in length. Also, the angles of the wedges defined by adjacent filter fabric panels 352 are generally equal in this example.

Figure 7:
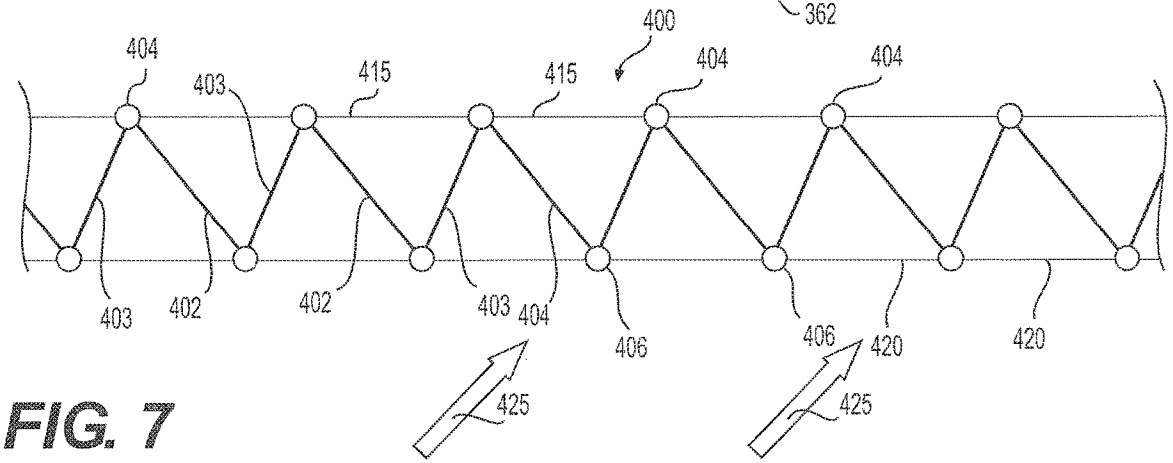

In FIG. 7, the silt fence 400 is slightly asymmetric. In other words, the water flow 425 is anticipated to hit the silt fence 400 at a slight angle. It may be presumed that this is a result of a unique topographical requirement. In any event, the upstream vertical support posts 406 are tethered together with spacer cords 420. Similarly, the downstream vertical support posts 404 are tethered together by a spacer cord 415. In this example, however, the filter fabric panels 403 are shorter than the filter fabric panels 402. This creates wedges between adjacent panels 403 and 404 having unequal filter fabric panel lengths. Again, this type of asymmetric configuration would be expected in a tilted topographical perimeter of a particular project site.

Figure 8:
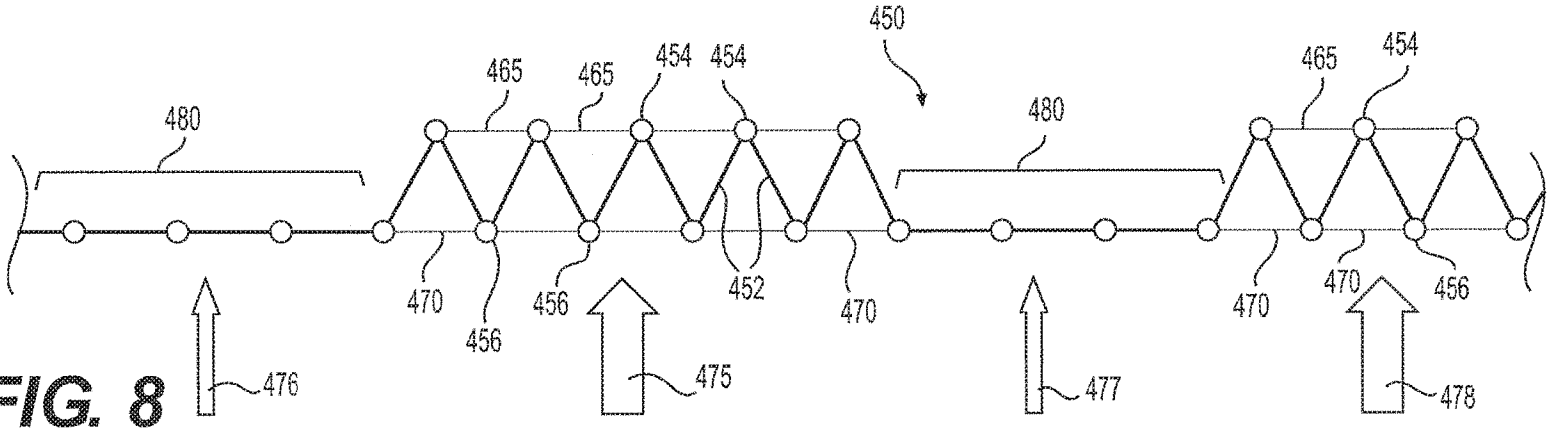

FIG. 8 illustrates a corrugated retention and filtration silt fence 450 that includes segments of corrugated retention and filtration fencing and also sections of linear fencing. In this example, the expected water flow arrows 475 and 478 are greater than the expected water flow arrows 476 and 477. This means that the low-flow sections of the fence 450 in front of water flow paths 476 and 477 are conventional linear fence portions 480. In the high-flow sections in front of water flow arrows 478 and 475, a corrugated fencing includes upstream vertical support posts 456 and downstream vertical support posts 454. The upstream support posts 456 are tethered together with spacer cords 470. The downstream support posts 454 are tethered together with a downstream spacer cord 465. The adjacent filter fabric panels 452 between respective upstream and downstream posts are equal in length.

Figure 9:
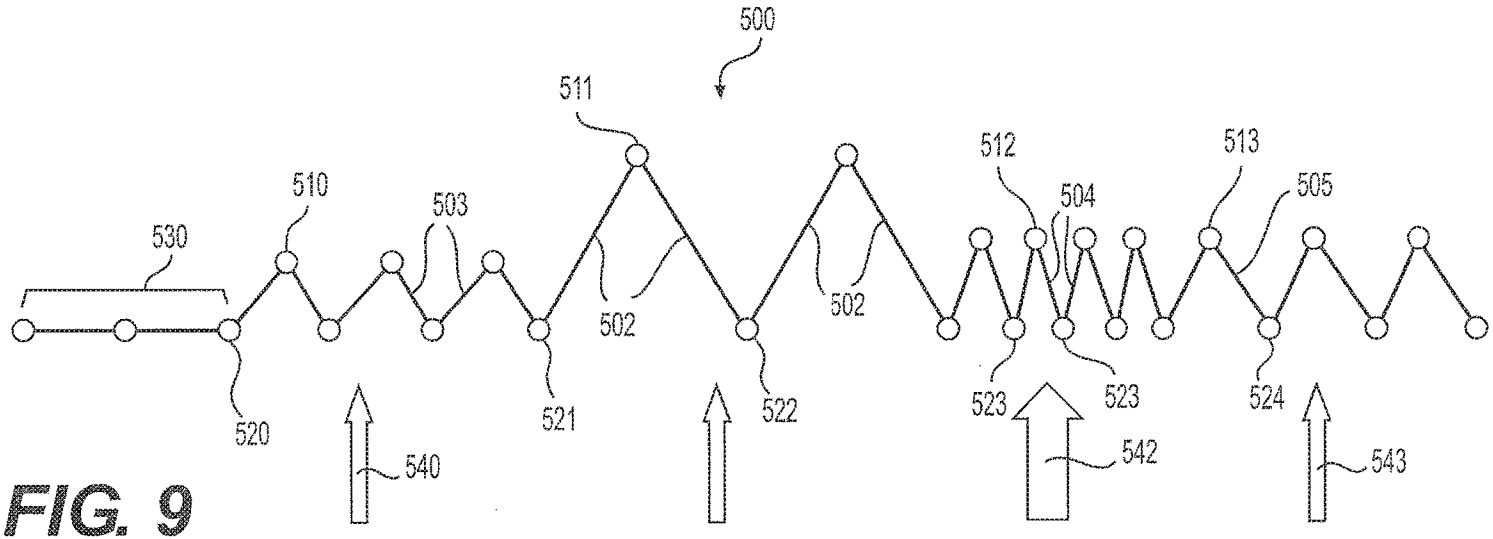

FIG. 9 demonstrates another custom silt fence 500 engineered to meet the hypothetical specific requirements of a particular project site. This example silt fence section may be in a section of a much longer linear fence section 530 that can extend from one or both edges of the corrugated system. There may be a corrugated fence section generally opposite the water flow arrow 540 that includes upstream vertical support posts 520 and downstream vertical support 510. The filter fabric panels 503 extend between the respective upstream posts 520 and downstream posts 510. Larger, in terms of both depth and width, wedges are formed by adjacent filter fabric panels 502 that extend between upstream vertical support posts 521 and 522 and downstream vertical support posts 511. In the portion of this fence 500 that is opposite the high water flow arrow 542, the corrugated fence is tighter as formed by upstream support posts 523 and downstream vertical support posts 512 with the filter fabric panels 504 there between. As is visually apparent, this section of the fence 500 having tight wedges formed by the adjacent filter panels 504 is better engineered to brace against and retain and filter a higher water flow. A still further section of the fence 500 is opposite the water flow 543. This includes upstream vertical support posts 524 and downstream vertical support post 513. The filter fabric panels 505 are, for instance, longer than the filter fabric panels 503 that define a different portion of this silt fence 500. It will be noted that this fence 500 illustrated in FIG. 9 does not include any spacer cords. The spacer cords may optionally be deployed with such a fence system if desired or needed in anticipation of the given project site requirements.

Figure 10:
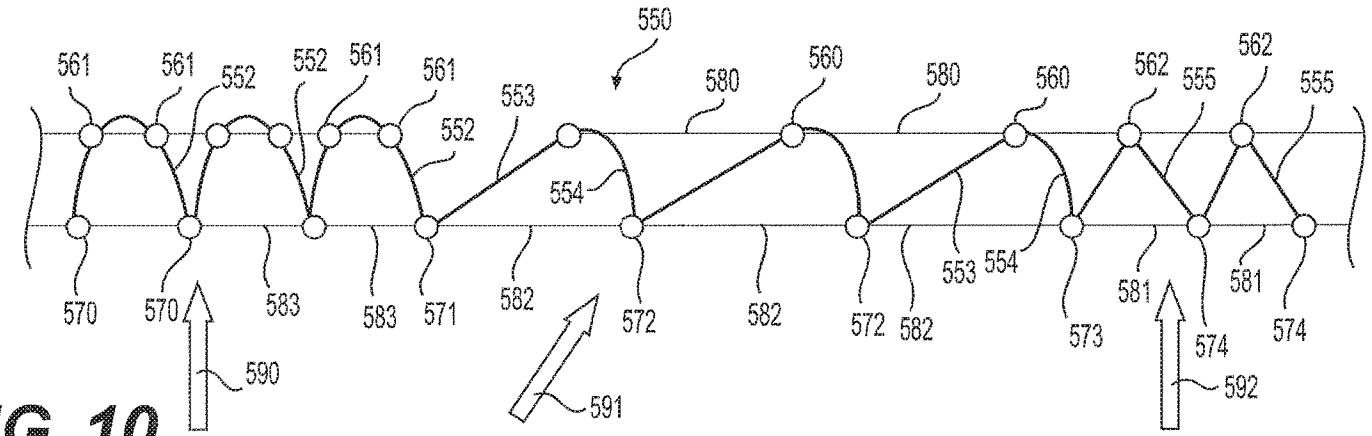

FIG. 10 illustrates a still further alternative embodiment of a corrugated retention filtration silt fence 550. All of the earlier drawings of corrugated systems include essentially flat or straight filter fabric panels. In this embodiment in FIG. 10, there may be curved corrugations. For instance, upstream support posts 570 and downstream support posts 561 define curved filter fabrics 552 there between. This curve may be a geometric curve, for instance a sine curve or Fibonacci curve. Alternatively, they could just be semicircular in form. This section is shown opposite the water flow arrow 590. Opposite the water flow area 591, the wedges formed of filter fabric panels 553 and 554 are shown with one straight panel 553 and one curved panel 554 that extend between upstream support posts 572 and downstream support posts 560. Again, there is no specific or limited definition as to the type of curve shown in the curved panel 554.

Finally, in FIG. 10 the fence 550 includes a small corrugated portion opposite the water flow 592 that includes the already-discussed equal triangular wedges. In other words, upstream support posts 574 and downstream support posts 562 and the filter fabric panels 555 therein form equal triangles there between. Also shown in FIG. 10 are spacer cords 583 in the upstream side of the fence in front of water flow arrow 590. There are also different length spacer cords 582 between upstream support posts 571, 572 and 573. Finally, there are still further spacer cords 581 between the respective upstream support posts 573 and 574. On the downstream side, there is a spacer cord between the downstream support posts 561 and also a spacer cord 580 between the downstream support posts 560.

Figure 11:
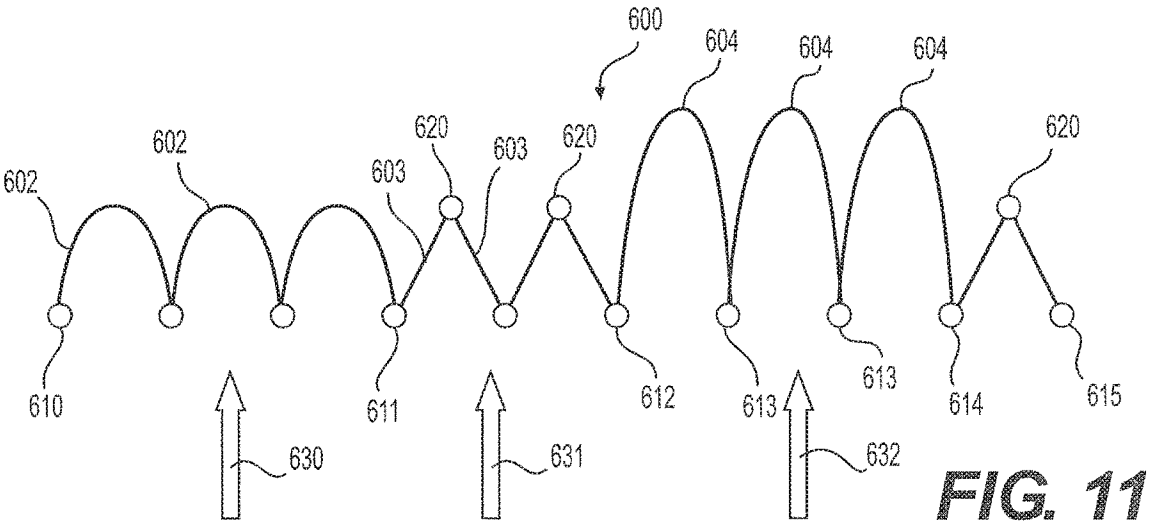

FIG. 11 demonstrates a corrugated retention filtration silt fence 600 that includes both curved and triangular portions. Opposite the water flow 630, there are upstream vertical support posts 610 and curved lengths or loops of filter fabric panels 602 there between. In this particular example, there are not downstream vertical support posts. Opposite the water flow 631, there are the triangle wedges formed by filter fabric panels 603 between upstream support posts 611 and 612 and downstream support posts 620. The portion of the fence opposite the water flow 632 simply illustrates different sized loops of filter fabric panels 604 that extend between the upstream support posts 612, 613 and 614. Finally, there is shown a single wedge that is formed between the upstream support posts 614 and 615 and downstream support posts 620.

Performance features of the corrugated retention and filtration systems process can also be applied to drop inlet protection and curb inlet protection devices. These devices must service a relatively large surface runoff area entering a comparatively narrow sediment retention zone compared to that of a traditional silt fence installation. As a result, dimensions and system components used in corrugated retention and filtration systems for these inlet protection devices may vary somewhat from those traditionally used in the process for silt fence structures, especially for curb inlet devices that have restrictions on height, width, and depth to be able to fit into the inlet structure. But the principals of design, construction, and performance still apply to the corrugated retention and filtration system and its structural components in both drop inlets and curb inlets.

Drop Inlet Example

The corrugated retention and filtration system can also be built around a drop inlet structure to prevent sediment runoff from entering and contaminating the inlet catch basin and the runoff transport system downstream.

A drop inlet is typically a rectangular or square open grate or mesh or a round perforated lid or any other opening geometry that allows storm water runoff to be collected and transported away by gravity flow through a storm water system. The corrugated system described herein may, in a top view, be circular, square, rectangular, hexagonal, asymmetric, or any other geometry that encircles the perimeter of a drop inlet drain.

In one example, the drop inlet system is a four-sided structure made up of four different filtration units that surround the perimeter of a drop inlet. In the four-sided example, each side is long enough to run the length of one side of the drop inlet structure. In some conventional examples, each filtration unit can therefore be three feet to ten feet in length. Each unit is a box structure that is open on the front side and on the rear side with the bottom, top and sides being solid panels. Alternatively, may have no solid panels on top, bottom and sides of a unit. Instead, there can be an open frame with optionally no top and an apron across the bottom of the structure. Silt laden fluid enters one side of the box unit, seeps through the filter medium in the box unit, and then exits out the back side of the unit. Inside the unit, there are adjacent wedges of filter fabric material. Vertical support posts inside the box create the wedge structure that has been described herein. These wedges form acute angles. These units can be approximately 12 inches or more in depth depending on the amount of filter fabric that is needed to be used to adequately retain and filter the silt laden fluids that will travel through the unit. The height of each unit will likewise depend on the expected volume of silt laded fluids, but the height may be for example 6 to 24 inches, or alternatively about 12 to 18 inches. In a four-sided system, one unit is placed on each side of a drop inlet. The corners of each unit are connected to prevent the silt laden fluid from bypassing the filter box. The units may be physically connected together through a hinge structure at their adjacent corners. Alternatively, they may be simply mounted adjacent each other to eliminate or minimize any liquid flow through the gap between units.

In an alternative structure, the unit may be a single piece or multi-piece annular ring that can be mounted around a drop inlet structure. In this case, the outside edge of the box structure is curved as is the inside edge of the unit structure. There may be a single annular unit that is mounted around an inlet. Alternatively, two semi-circular, half-annular structures could be attached together around a drop inlet location. There are similar filter fabric wedges that are fixed inside the structure that will retain and filter the silt laden fluid that passes through the structure. At one or two locations around the radial structure, there are solid walls that extend from the inside of the annular ring to the outside to maintain and support the structure inside.

In order to maximize the capture and filtration performance of a system, filter fabric may be secured also as an apron at the bottom of the box or hollow structure. A flap extends outside the outside edge of the unit so that it may be properly toed into the ground around the drop inlet structure to prevent any bypass of silt laden fluid underneath the unit. Likewise, the fabric on the bottom of the inside passageway in the box prevents any bypass underneath the fabric wedges inside the box. The fabric apron on the floor of the unit may be cut and sewn or otherwise attached to the back of the wedges in order to further assist in the retention and filtration of the silt laden fluid passing through the structure.

Figure 12:
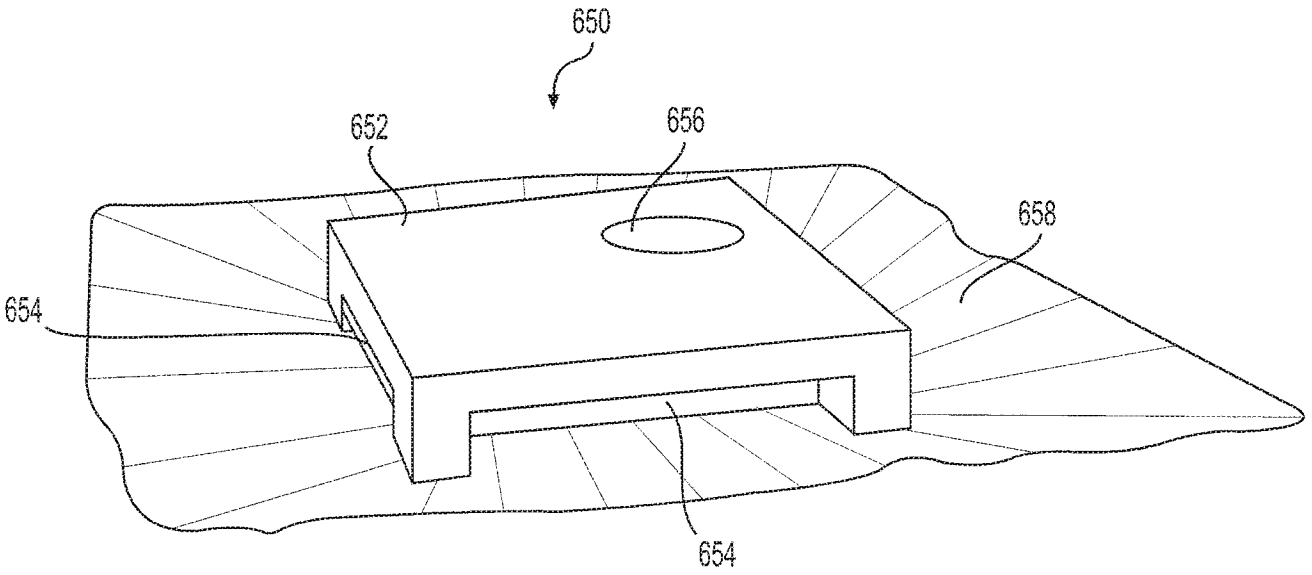
FIG. 12 is a perspective view of a generic drop inlet drain system.

Turning now to FIG. 12, there is shown a conventional drop inlet system 650 which includes a top cover 652 with inlet openings 654 all around it. The landscape 658 around the drop inlet system 650 is contoured to drain into the drop inlet system. There is also shown a manhole cover 656 that may or may not be included in the top cover 652 of the drop inlet system 650 in order to allow access into the structure for cleaning and maintenance purposes.

Figure 13:
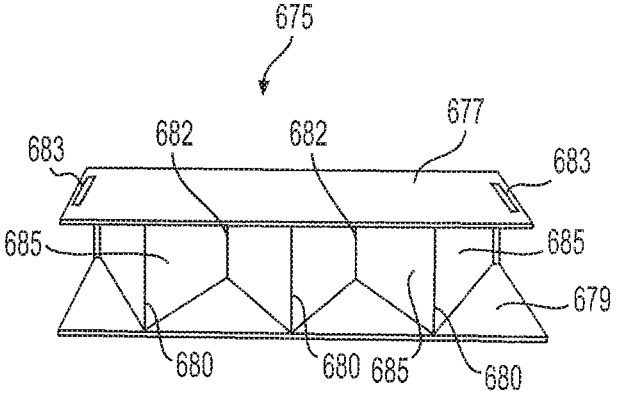
FIG. 13 is a perspective view of a drop inlet corrugated filtration and retention system unit as described herein

FIG. 13 illustrates an example of a filtration unit 675 that may be deployed around a drop inlet system. The filtration unit 675 includes a top panel 677 and bottom panel 679. Those panels 677 and 679 are separated and held apart by upstream vertical posts 680 and downstream vertical posts 682. Wrapped around or otherwise attached to those posts 680 and 682 is filter fabric forming filter fabric panels 685. Note that the filter fabric panels 685 are formed in a wedge construction that forms acute angles between adjacent panels 685 with the vertex at the downstream vertical support posts 682. As explained earlier, the panels 677 and 679 may be approximately 3 to 10 feet in length and approximately 1 to 3 feet, alternatively 1 to 2 feet in depth. The height of the unit 675 is defined by the height of the support posts 680 and 682 and may be approximately 6 to 24 inches, or alternatively about 12 to 18 inches. Optionally, the unit may include handles 683 so that it may be easily moved by an installer of the system.

Figure 14:
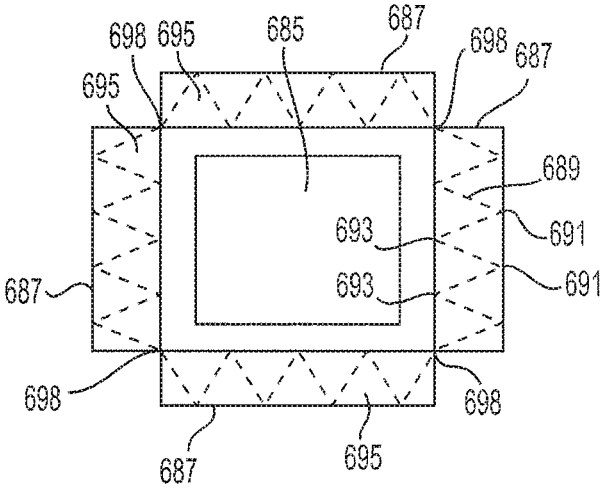
FIG. 14 is a top view of a drop inlet corrugated retention and filtration system around a drop inlet.

FIG. 14 is a top view of a rectangular drop inlet 685 surrounded by four filter units 687. The top 695 of each unit is shown as is the geometry of filter fabric wedges therein. Upstream posts 691 and downstream posts 693 include fabric panels 689 attached to alternating, next adjacent posts upstream 691 and downstream 693. Each of the filtration units 687 is connected at a downstream corner 698 to the next adjacent filtration unit.

Figure 15:
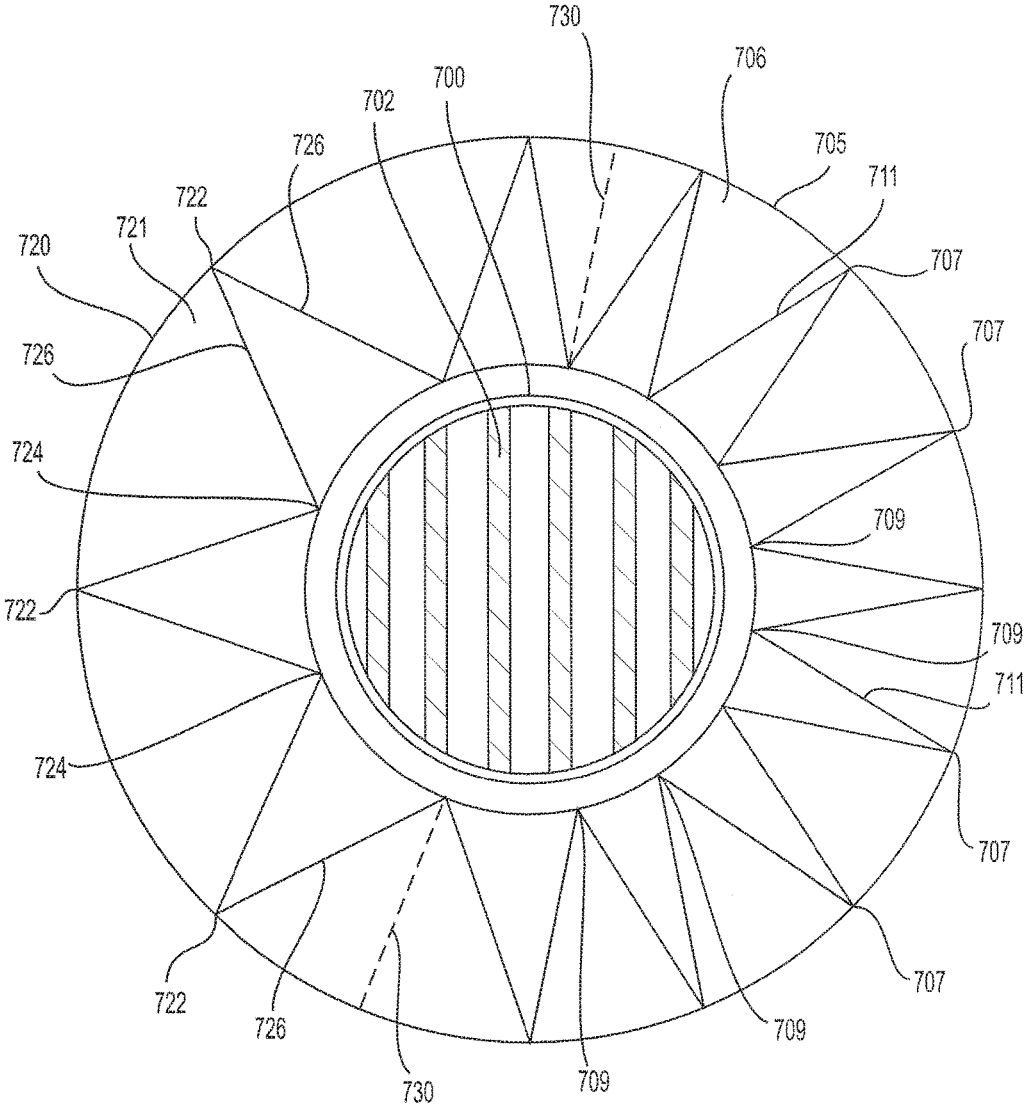
FIG. 15 is a top view of a circular version of the corrugated retention and filtration system mounted around a drop inlet.

FIG. 15 is another example of a drop inlet filtration system. In FIG. 15, a round, open grate drop inlet 700 includes grate element 702 that extend across the drop inlet yet allows water to fall into the system drain. In FIG. 15, there are two, semi-circular and annular filtration units 705 and 720. These units 705 and 720 are connected along a seam or edge 730 there between. This may be a hinged connection or some other securement between the two units 705 and 720.

Unit 705 includes a top panel 706. There is also a bottom panel not shown. The unit 705 includes upstream vertical posts 707 and downstream vertical posts 709 that are mounted proximate the outside diameter and inside diameter respectively of the filtration unit. Filter fabric panels 711 are formed by filter fabric that extends between the respective adjacent upstream vertical posts 707 and downstream vertical posts 709. The fabric panels 711 form acute angle wedges together with their next adjacent panel.

Semi-circular filtration unit 720 includes a top panel 721 and bottom panel not shown. Upstream vertical support posts 722 and downstream vertical posts 724 have filter fabric panels 726 wrapping around and extending there between. These filter fabric panels 726 form acute angles and wedges between adjacent panels. The wedges formed by the adjacent panels 726 are wider, but still acute angle, as compared with the wedges formed by the panels 711 in unit 705. A unit may have uniform-sized filter wedges all around an inlet or as shown, the wedges may have different acute angles. While this overall unit in FIG. 15 is shown as being two halves of a circle, the units could alternatively be split into thirds or quarters or other geometries to encircle a drop inlet like drop inlet 700. For instance, the filtration units could be rectangular or some other geometry around the round inlet 700.

Figure 16:
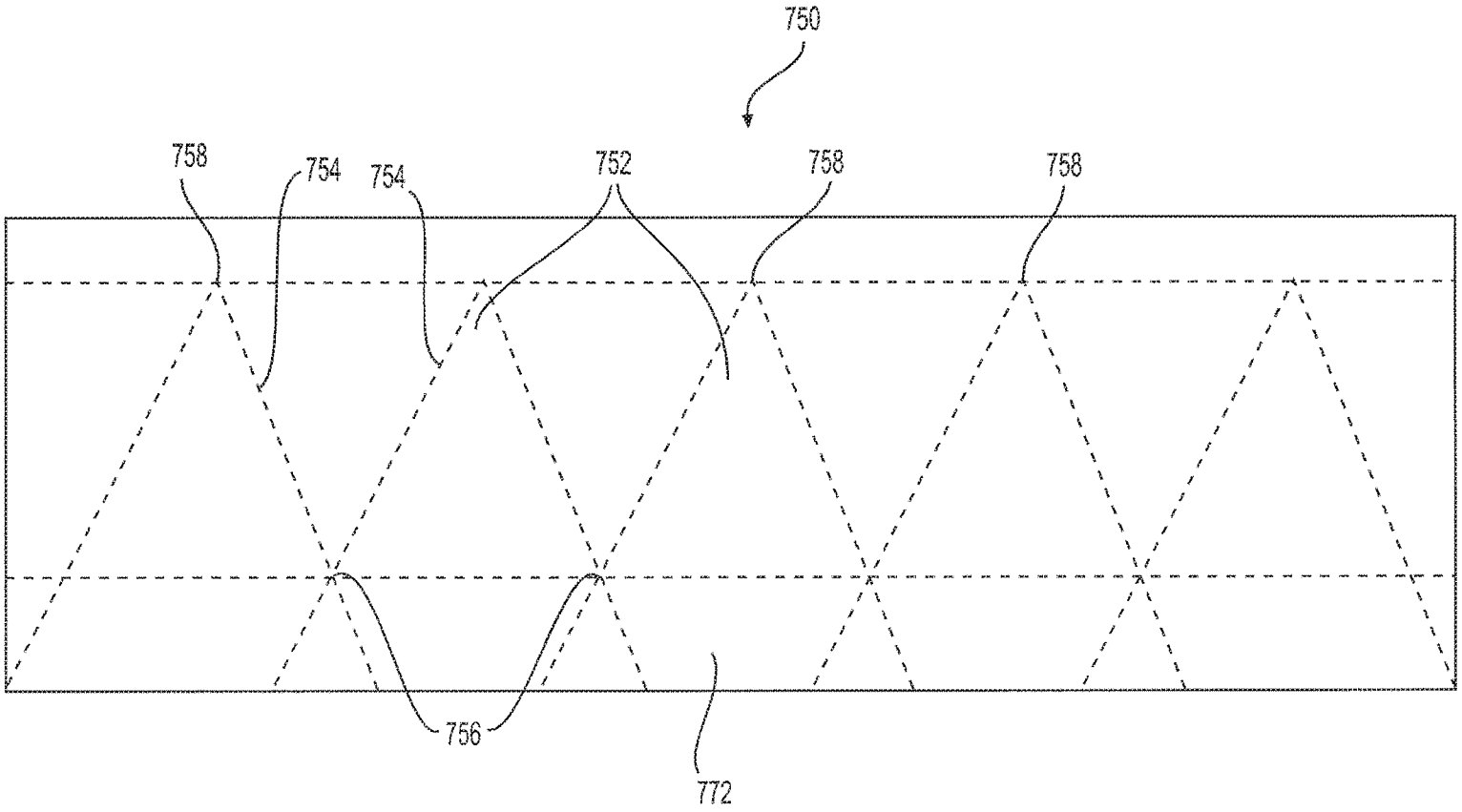
FIG. 16 illustrates an apron of filter fabric as described herein.

FIG. 16 illustrates an apron feature that may be used with a drop inlet filtration unit. The purpose of the apron is to prevent or minimize the bypass of silt laden fluid around or underneath the retention and filtration system. The apron 750 is a flat sheet of filtration fabric. The dotted lines 754 are the location of the line where vertical filter fabric panels will zig-zag across the width of the apron. The apron 750 is secured optionally to the bottom of the vertical fabric panels to prevent unfiltered passage of sediment laden fluid beneath the retention and filtration system. The triangular sections 752 of the apron 750 correspond to the wedges formed by the adjacent filter fabric panels along lines 754. Upstream support post vertices 756 and downstream support post vertices 758 indicate the location of the support posts in the filtration unit. Finally, a front flap 772 extends upstream from the apron 750. The flap 772 maybe firmly fixed or toed-into the surrounding ground in front of the filtration panel unit to prevent any silt laden fluid from running underneath that unit.

Curb Inlet Example

The corrugated retention and filtration system described herein also has application to curb inlet drainage systems. These curb inlet protection units are in many ways similar to the drop inlet retention and filtration units described earlier herein. Curb inlet protection units are intended to prevent storm water runoff from transporting sediments and larger debris into a storm water catch basin below an inlet. Existing commercially available protection systems are essentially linear barriers that block or retard flow into an inlet port and filter sediments or debris as it seeps through that device. Unfortunately, existing devices may in some situations become partially or completely blocked which results in storm water flow being reduced or blocked.

The filter medium that may be used in this curb inlet protection unit may be essentially the same or similar as a filter fabric used in silt fences or drop inlet filters. However, if greater seepage rates through a system are required, the filter medium may be a woven monofilament or a more open mesh netting or grid geometry to accommodate downstream flow but still provide sufficient filtration to prevent the passage of large sediment particles and debris. Examples of these filter medium products include woven monofilament fabrics with Apparent Opening Size, AOS from #30 to #70 US Standard Sieve Size and porosity greater than 10% to 20%. If mesh or grid structure is used, its aperture size might range from ¼"×¼"up to 1"×1" and larger. These open mesh filters are intended to filter large debris from entry into the inlets catch basin. Sediment retention will require a finer aperture size.

Structurally, in general terms, the curb inlet protection unit includes a top frame and a bottom frame separated by and secured together by vertical support posts. The top and bottom frames are trapezoidal in shape for easy insertion into a curb inlet. The filter medium as described here is secured to the alternating upstream and downstream vertical support posts to form the angles and create the retention and filtration wedges described herein wherein the wedges have acute angles with the vertex being the downstream vertical support posts. The filter medium connection to the vertical support posts can be achieved by way of sleeves hemmed into the filter medium at predetermined lengths that span between the upstream and downstream vertical support elements. Alternatively, the fabric can be tightly wrapped around or stapled in appropriate locations to secure the filter medium around the vertical support posts.

An apron as described herein can be connected to the base and to the top of the wedges formed of vertical filter panels.

This would eliminate any unfiltered passage of runoff below or above the curb inlet unit. The top apron is included to contain any overflow of the vertical filter panels. The pore size and porosity of the various top and bottom aprons as compared with each other and as compared with the vertical filter panels may be different. For instance, in one example, the vertical filter panels may be specified as a woven monofilament with porosity >30% and AOS of #30 to #70 US Std Sieve Size. The bottom apron may be specified as a nonwoven filter fabric with porosity >30% and AOS=#70 US Std Sieve Size or finer. The top apron may have the same specification requirements as the vertical filter panel.

The height and length of the curb inlet units may vary as the inlet opening dimensions for curb inlets will vary. It is expected that the curb inlets will vary in height of between typically 4 to 6 inches from the surface of a roadside shoulder to a concrete curb atop the inlet opening. The total width of opening of a curb inlet from edge to edge will also vary significantly from, for instance, 1.5 feet to 12 feet or more. The curb inlet protection units can be built in uniform increments, for instance 2 feet, 4 feet or 6 feet to allow for single or multiple units to accommodate a given curb inlet dimension. The depth of penetration for the curb inlet filtration system will typically be from approximately 12 to 18 inches. The maximum depth of penetration is limited by the distance from the inlet port to the drop portal down into the catch basin below the inlet.

If more than one curb inlet filtration unit is used, then connector plates may be deployed to connect adjacent units together along their lateral sides. This prevents any leakage of unfiltered water flow in between filtration units. Similarly, there may be terminal end plates that seal any distance, if at all, between a side edge of a curb inlet filtration unit and the side of a curb inlet. Finally, the curb inlet unit may include stop plates that are attached along some or a portion of the top of a curb inlet protection device, or alternatively the connector plates can be extended upwardly an additional approximately two inches to prevent the curb inlet unit from being accidently inserted into the inlet port. The curb inlet devices can be retained against the front of a curb inlet through use of the terminal end plates and stops that may be the tops of connector plates or, alternatively, independent stop plates that are secured to the top edge of a curb inlet filtration device.

Figure 17:
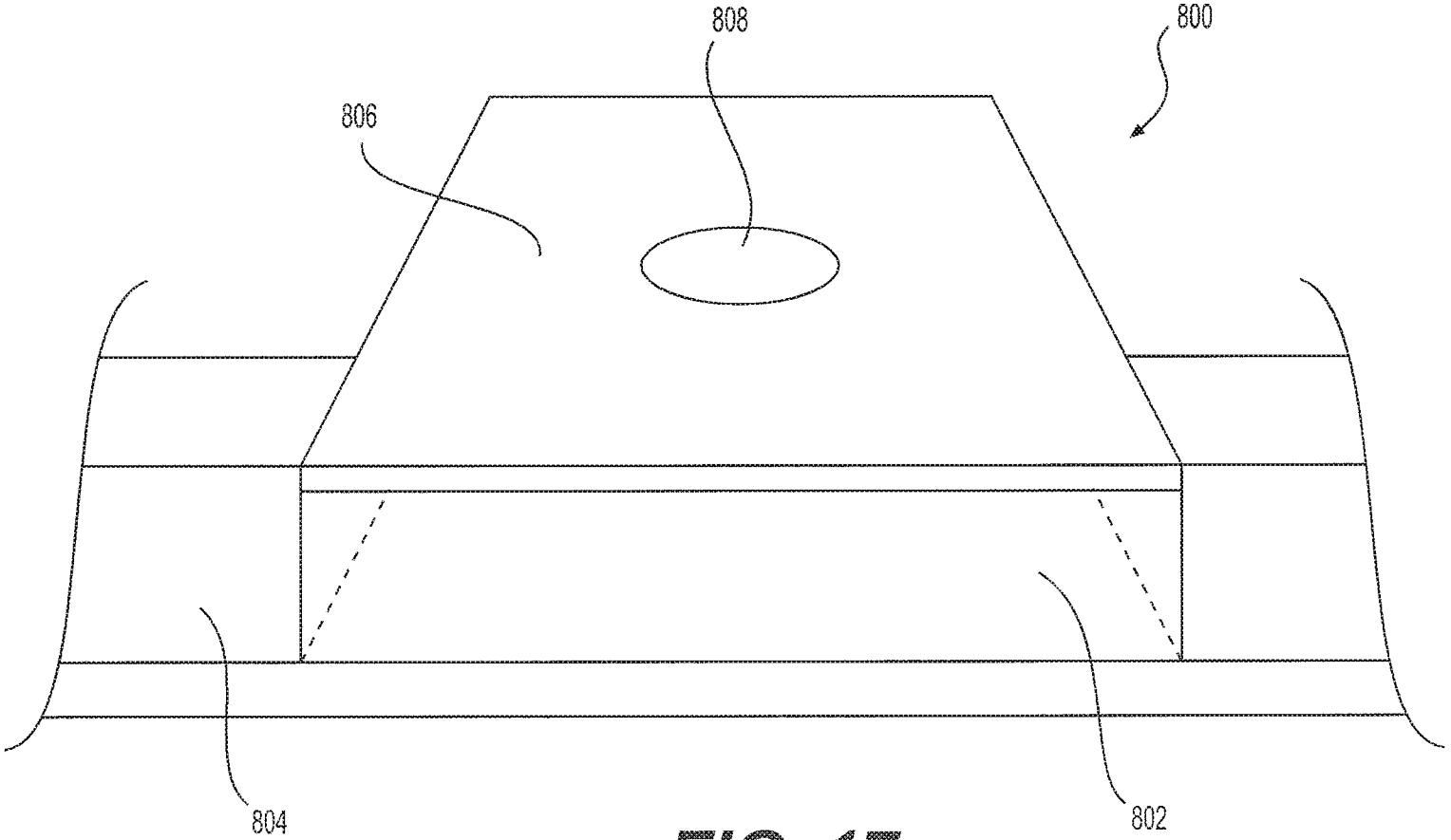
FIG. 17 is a front perspective view of a conventional curb inlet drain system with no protection apparatus to prevent sediment laden fluid from entering the inlet.

Turning again to the figures, FIG. 17 illustrates a representative curb inlet structure 800. There is an open inlet 802 adjacent the curb 804. The curb inlet 800 includes a top cover 806 with a manhole cover 808 to allow access for maintenance and repair.

Figure 18:
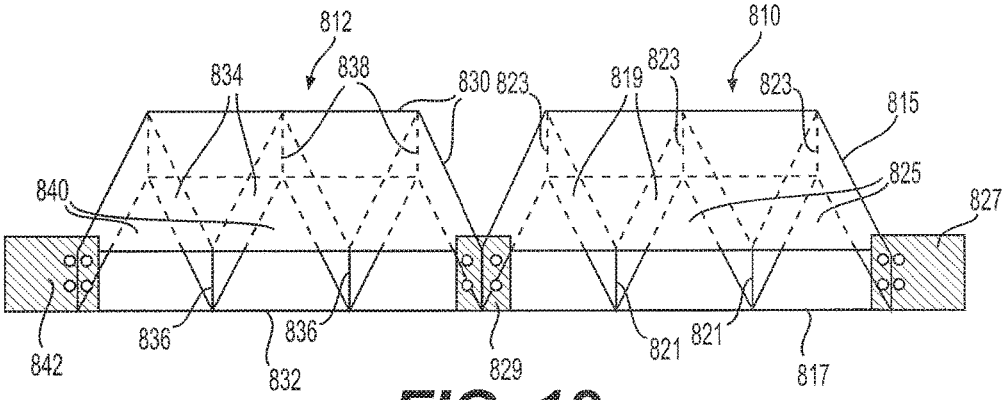
FIG. 18 is a front perspective view of curb inlet corrugated filtration and retention system units as described herein.
Figure 19:
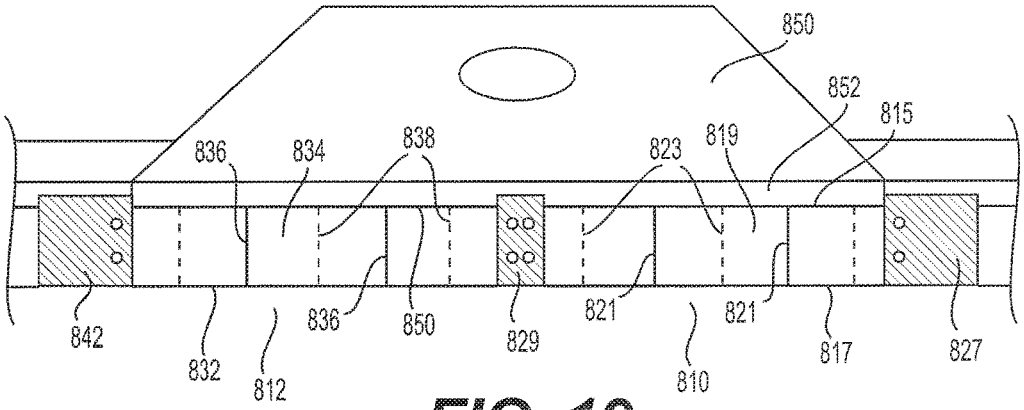
FIG. 19 is a front perspective view of the corrugated retention and filtration curb inlet units as installed in a curb inlet.
Figure 20:
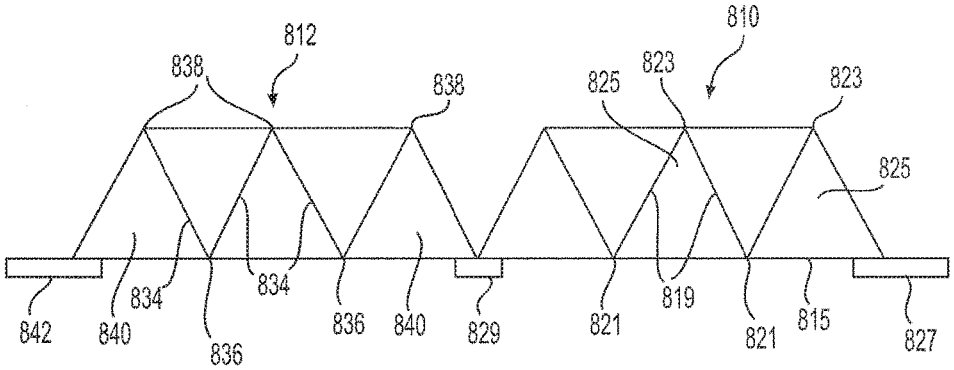
FIG. 20 is a top view of the curb inlet corrugated filtration and retention system units shown in FIGS. 18 and 19.

FIGS. 18-20 illustrate a pair of curb inlet filtration and retention units 810 and 812. Each of these units 810 and 812 is essentially the same in structure. The units 810 and 812 include a top frame 815 and 830 respectively. Each unit 810 and 812 has a bottom frame 817 and 832 respectively. Each of these frame portions 815, 817, 830 and 832 are trapezoidal in shape. This trapezoidal shape facilitates insertion of the narrow backside into a curb inlet 850. Attached to the top frame 815 and bottom frame 817 are upstream vertical support posts 821 and downstream vertical support posts 823. Similarly, top frame portion 830 and bottom frame portion 832 are connected and spaced apart by vertical support upstream posts 836 and downstream posts 838. Connected to and/or wrapped around each of the alternating upstream and downstream vertical support posts 821 and 823 are filter fabric panels 819. Similarly, attached to and/or wrapped around the upstream vertical support posts 836 and downstream vertical support posts 838 are filter fabric panels 834. The adjacent filter fabric panels 819 and 834 form acute angled wedges 825 and 840 respectively with the downstream vertical support posts serving as the vertex of those angles. Those wedges 825 and 840 may further have apron filter fabric thereon that is connected along the angle lines of the filter fabric panel 819 and 843 wedges.

At the front sides of the filtration unit 810 there is a side terminal end plate 827 and a connector plate 829. Connected on the sides of the curb inlet filter unit 812 are a terminal end plate 842 and the connector plate 829. The connector plate 829 is connected on one side to unit 810 and on the other side to unit 812. As illustrated, the terminal end plates and connector plate have a height greater than the height of the filtration units 810 and 812. Accordingly, those terminal and connector plates serve also as a stop to prevent the filtration units 810 and 812 from being accidentally inserted all the way into a curb inlet.

Submerged Silt Barrier Example

Submerged silt barriers go by many names including turbidity curtains and silt curtains. In each case, these are submerged barriers that are secured at the top to flotation devices and that are anchored at their base so that the base rests on the bottom of the body of water where the submerged silt barrier will be deployed. Submerged silt barriers are engineered to retain floating turbidity or suspended sediments within a body of standing water to prevent the uncontrolled dispersion of that turbid or sediment laden water into the clean water adjacent a work site. Submerged silt barriers may be deployed, for instance, adjacent lakes, streams, rivers or other waterways and impoundments. Sedimentation control is required around marine construction, pile driving, dredging, or earth work grading activities within or adjacent to waterways. Other typical construction sites include ditches, canals, small ponds, lakes and harbors where typical construction may be ongoing.

Silt barriers that are most often referred to as "turbidity barriers" are used to totally contain turbid water within a restricted region of confinement in a body of water. These turbidity barriers are intended to stop all turbid water from passing downstream. Turbidity barriers are typically an impermeable liner material such as polyvinyl chloride (PVC) that extends from the system flotation device down to the system anchorage at ground level.

Silt barriers can also be used to temporarily retain turbid water, allowing particles to settle from suspension, while at the same time, filtering sediments from suspension as fluid is allowed to seep through a filter medium located within the system's vertical barrier. The filter medium can be a segment of the barrier positioned at select elevations and or locations between the flotation at the top and anchorage at the bottom or the entire barrier from flotation to anchorage. These barriers are most often referred to as "silt curtains." In this example, a filter fabric could be part of or the entire area of a silt barrier attached to the flotation and anchors of a system.

If there is no limit on time of containment for turbid water, then the function of a silt barrier is merely retention with no requirements for filtration performance, e.g., turbidity barrier. However, if a filtered seepage through the silt barrier is required or advantageous, then it has been observed that the total area of a filter medium that separates turbid water from clean water is a predominant factor controlling the rate of filtration and release of the cleansed fluid through the system performance. A corrugated retention and filtration system as described herein can reduce the time of retention by increasing the rate of filtered seepage through a submerged silt barrier.

The structural components of a corrugated retention and filtration silt barrier are different than previously disclosed herein. A submerged system requires no vertical support posts to maintain vertical erection above the ground or floor of a body of water. Vertical support posts may be deployed in shallow water applications, but they are not required. Instead, a submerged silt barrier typically maintains a vertical posture by using flotation devices on top of the silt barrier and anchors at the base of the silt barrier with connector cables or chains between the flotation and anchor. The cable or chain is typically held within a vertical hem in the submerged silt barrier, e.g., filter fabric.

The filter fabric material that may be deployed in a submerged silt barrier is likely dependent upon regulatory specifications. However, given the increased surface area of filter fabric that is made available in connection with the corrugated system described herein, it is possible that variations and porosity of a submerged silt barrier might be available. A typical filter fabric for submerged silt barriers might be specified as a woven monofilament (see previous reference to woven monofilament) or even a heavy weight needle punched non-woven. Actual physical properties are based on the filtration and strength performance requirements for each application.

As indicated earlier herein, the top edge of the submerged barrier filter fabric includes a flotation device. This flotation device can be, for instance, a continuous length of flexible foam material. It can be a more rigid foam structure. There may be specific lengths of flotation material that are segmented together along the top of the filter fabric.

In one example, a submerged silt barrier may have predetermined length segments with tie-offs at each predetermined length. These tie-offs may be spaced to equal the length of a filter fabric panel. Alternatively, the tie-offs may be spaced so that they equal the length of two filter fabric panels. These lengths may or may not correspond to predetermined lengths of flotation materials.

The bottom edge of a submerged silt barrier includes anchors that retain the bottom edge of the filter fabric on the bottom surface or floor of a body of water. This anchor may be in the form of a weighted hem at the bottom of the filter fabric. Alternatively, there may be weights tied to the bottom of the filter fabric at predetermined distances wherein the weights hold the bottom. Still further alternatively there may be stakes or other rigid posts that can be inserted into the bottom or floor of a body of water to hold the bottom of a submerged silt barrier in place. Each of these options for the bottom of a submerged silt barrier are referred to collectively as an anchor. The bottom edge of a submerged silt barrier may also have tie-offs fixed along predetermined lengths thereof.

In order to create a corrugated submerged silt barrier, spacer cords are used to be connected with the tie-offs on the upper flotation edge and the bottom anchor edge of the filter fabric. The spacer cords would have a length less than the distance between the two tie-offs that they would be connected to. This creates a triangle of extra filter fabric material. The spacer cords would be selected for length so that an acute angle is formed in between the two tie-off locations. The tie-offs may be joined in series using a single spacer cord or a series of cords along the upstream vertices of a submerged silt barrier. Alternatively, or in addition thereto, a spacer cord may connect to and used in connection with the tie-offs of a downstream vertices of a submerged system. The spacer cord may be deployed only along the top or flotation side of a submerged silt barrier. The spacer cords may be deployed only along the bottom edge and upstream side of a submerged silt barrier. Similarly alternatively or additionally, spacer cords may be deployed with the downstream vertices of both the flotation edge of the submerged silt barrier and the bottom edge of the submerged silt barrier.

Figure 21:
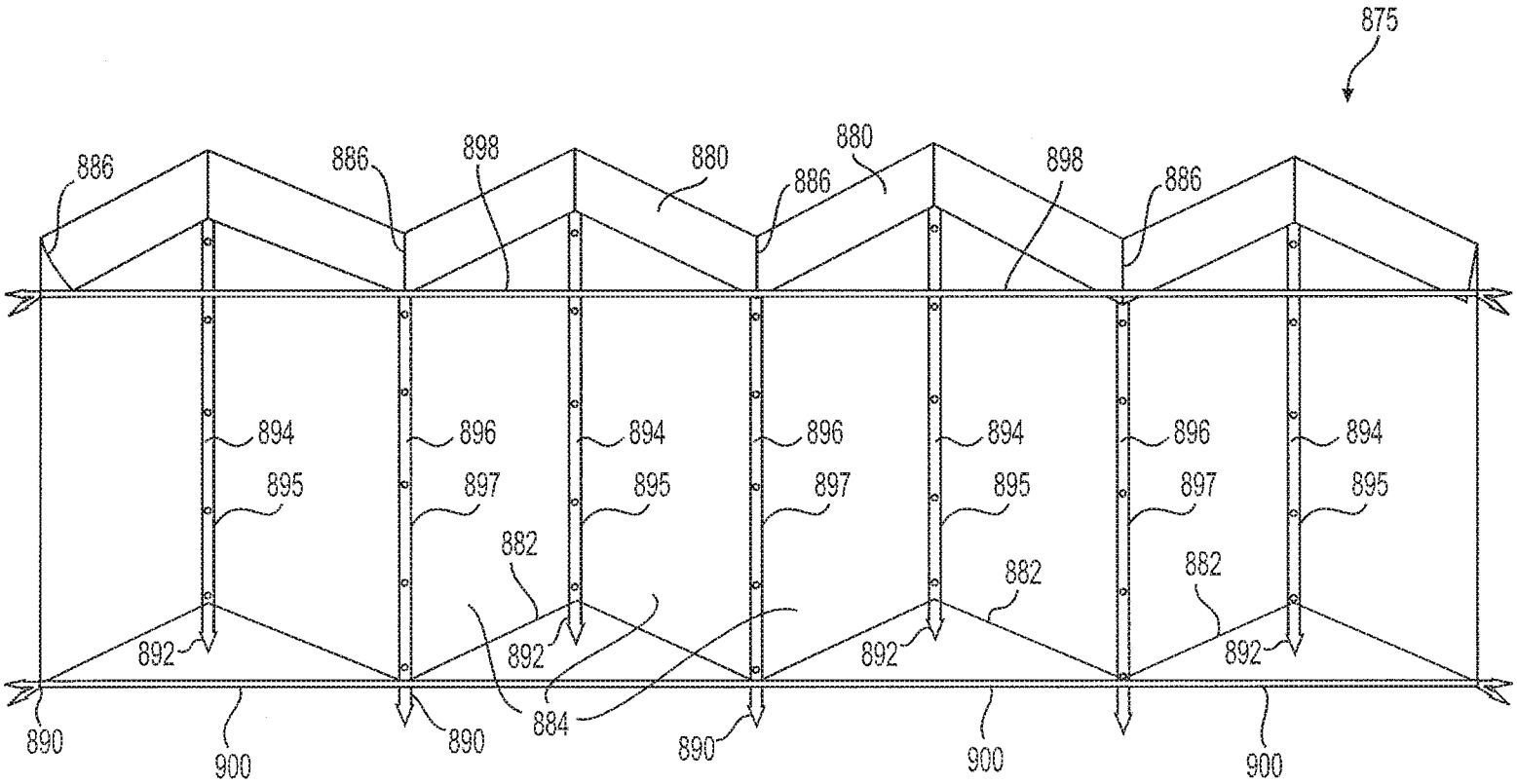
FIG. 21 is a perspective view of a submerged corrugated filtration and retention system.

Turning now to FIG. 21, there is shown an example of a submerged silt barrier 875. The silt barrier 875 includes flotation elements 880 and a bottom edge 882. The submerged silt barrier 875 defines alternative filtration fabric panels 884. The silt barrier 875 is formed of angles having upstream vertices 896 and downstream vertices 894. At least the downstream vertices 894 are defined in acute angle in connection with adjacent filter fabric panels 884. System anchors 892 are configured at the bottom edge of the upstream and downstream vertices 894 and 896. These anchors 892 are shown as rigid stakes that may be pressed into the floor or bottom of a lake or stream or other body of water. Retaining the submerged silt barrier 875 in its corrugated angled position, spacer cords 898 are deployed and connected to tie-offs 886 along the top of upstream vertices 896. As indicated, the length of spacer cord 898 between any pair of tie-offs 886 is less than the sum of the distance of two filter fabric panel 884 widths. Similarly, spacer cords 900 tie-off the upstream vertices 896 along the bottom of the silt barrier 875. The tie-offs 890 connect the spacer cord 900 so that the angles are formed by adjacent filter fabric panels 884. It is also noted that the silt barrier 875 as shown includes reinforcing tapes 895 along the downstream vertices and 897 along the upstream vertices. This is simply reinforcement of those particular portions of the silt barrier 875.

Alternative Corrugated Silt Fence with Apron

Figure 22:
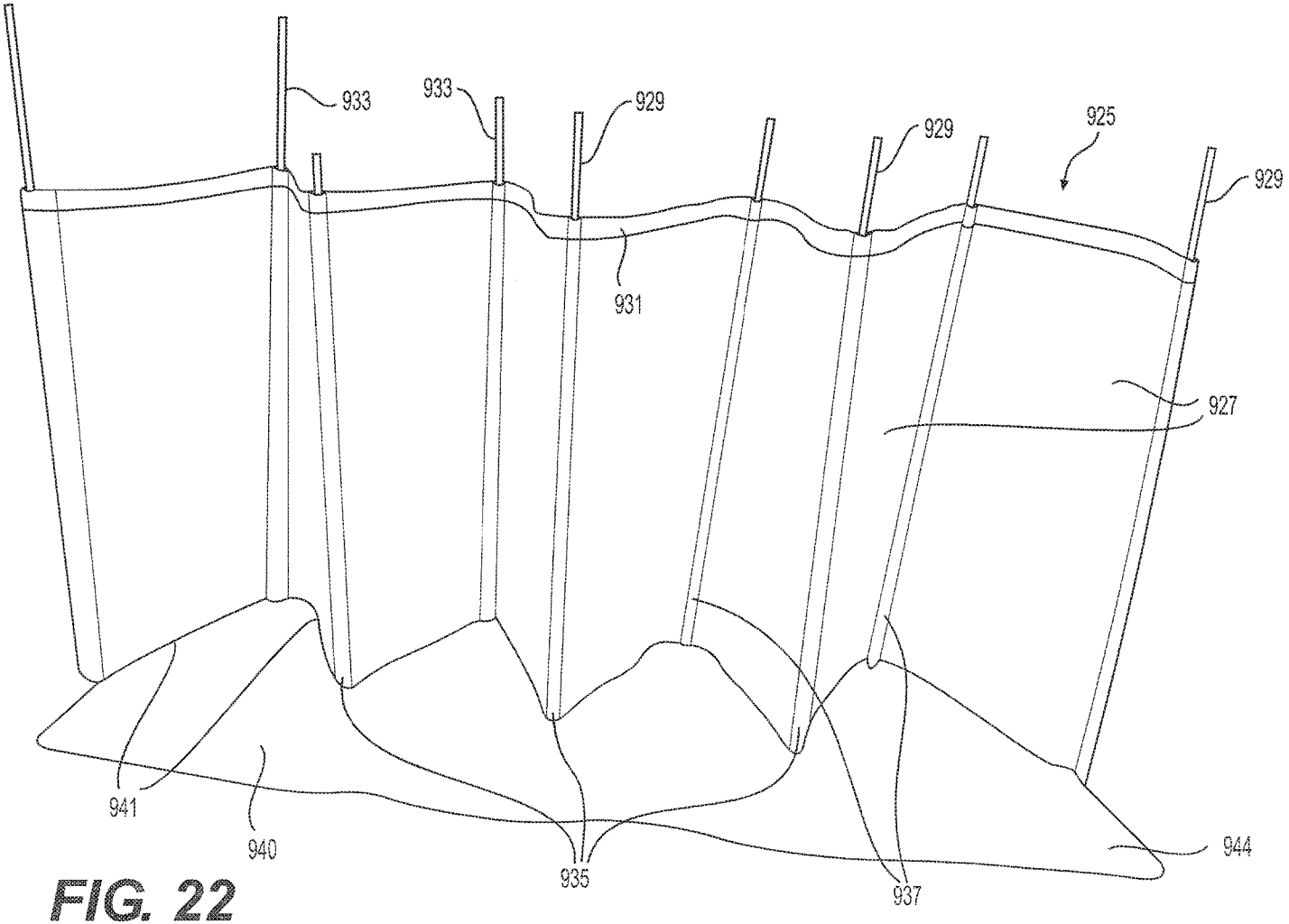
FIG. 22 is a perspective view of another example of a corrugated retention and filtration silt fence system.

FIG. 22 illustrates an alternative example of a corrugated retention and filtration silt fence. This alternative silt fence 925 defines pairs of filter fabric panels 927. There are upstream vertical support posts 929 and downstream vertical support posts 933. Geometrically, therefore, this alternative silt fence 925 is generally conceptually similar to the silt fence illustrated in FIG. 2. Alternative features include a reinforcing tape 931 along the top edge of the filter fabric panels 927. This reinforcing tape 931 adds integrity and strength to the filter fabric panels 927. Additionally, the upstream vertical support posts 929 are mounted inside vertical sleeves 935 that create a vertical sleeve pocket along the entire vertical length of the filter fabric panels 927. The vertical support posts 929 are slideably received and would likewise be removable, from, the vertical support sleeves 935. Similarly, downstream vertical support posts 933 are positioned in the downstream sleeves 937. These sleeves may run the entire vertical height of a filter fabric web. Alternatively, there may be one or two or more spaced loops on the face of the filter fabric that would receive and be used to retain the vertical support posts adjacent and fixed to the filter fabric.

Also illustrated in FIG. 22 is a silt fence apron 940. This is a layer of filter fabric that is on the horizontal ground surface or bottom of the filter fabric panels 927. This apron is connected to the bottom edge 941 of adjacent vertical filter fabric panels 927. This apron 940 prevents any silt laden fluid from bypassing and going underneath the silt fence 925. The apron 940 includes a front edge 944 that is intended to be used for toe-in purposes. That is, the front edge 944 will be buried several inches in the dirt on the upstream side of the fence 925 per specification requirements. Again, this prevents silt laden fluid from finding its way underneath or bypassing the silt fence 925.

Drop Inlet Example II

Figure 23:
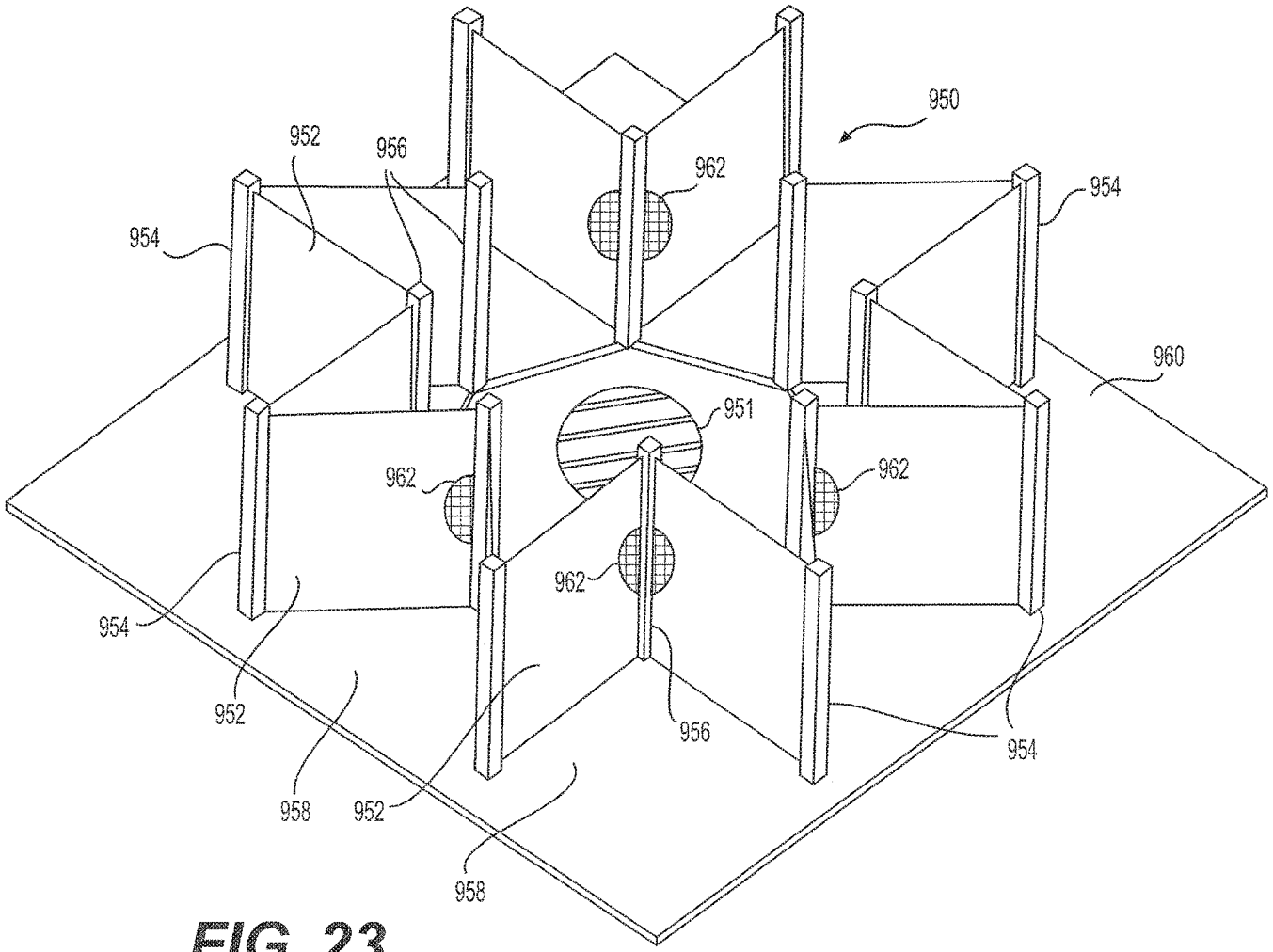
FIG. 23 is a perspective view of an alternative drop inlet retention and filtration system.

FIG. 23 illustrates an alternative example of a drop inlet retention and filtration system 950. In this example, there is no box structure. Instead, there is an eight-point star or octagonal structure of a drop inlet retention and filtration system 950 that is adapted for installation around a drop inlet drain 951. This alternative drop inlet retention and filtration system 950 includes adjacent filter fabric panels 952 that are segments of filter fabric that extend between upstream vertical support posts 954 and downstream vertical support posts 956. Adjacent filter panels 952 form filter wedges 958 as generally discussed herein. These filter wedges 958 are formed of acute angles wherein the downstream vertical support posts 956 are the vertex of that acute angle. The system 950 also includes an apron 960 which is a web of filter fabric that lies horizontally on the ground and around the entire structure 950. The inside of the structure 950 is cut out to allow water to drain through the drop inlet drain 951. The apron 960 includes portions that extend radially outwardly from the upstream vertical support posts 954. This extra portion of the apron 960 can form a toe-in portion that can be suitably buried in the ground to prevent any bypass underneath the retention and filtration system 950.

As shown, the retention and filtration system 950 is an octagon, or can be described as having eight star arms. Other geometric shapes may be envisioned for deployment around a drop inlet. These other geometries may be symmetrical as shown in system 950, or they may be asymmetrical depending on location requirements or desirability.

Additionally, there are no spacer cords shown on the system 950. However, it is and may be desirable for certain applications to have spacer cords tied at the top of, and/or bottom of, adjacent downstream vertical support posts 956. Additionally, spacer cords may be used to tie and connection adjacent upstream vertical support posts 954. In either case of spacer cords on the upstream or downstream support posts 954 and 956, the use of spacer cords is optional.

Finally, there are overflow ports 962 that are positioned approximately half way up along the vertical height of the vertices formed by the downstream vertical support posts 956. These overflow ports 962 are nothing more than windows that are cut out of the fabric panels 952 that prevent too much water from building up on the upstream side of the retention and filtration system 950 that could cause collapse and failure of that system. The relief overflow ports will preferably have some mesh that spans across the opening to prevent large objects from going into the drop inlet 951. However, they would allow the silt laden fluid to flow through to relieve the water pressure on the system.

Other embodiments of the present invention will be apparent to those skilled in the art from consideration of the specification. It is intended that the specification and figures be considered as exemplary only, with a true scope and spirit of the invention being indicated by the following claims.

What is claimed is:

1. A corrugated retention and filtration system comprising:

a plurality of three or more vertical support posts adapted to be mounted partly in-ground and having a portion of the posts extending generally vertically above-ground;

a web of porous, filter fabric that is connected to each vertical support post and forms a panel of filter fabric between each adjacent pair of vertical support posts and wherein the vertical support posts comprise in alternate position upstream and downstream vertical support posts adapted to be positioned on upstream and downstream sides of the system respectively;

wherein each filter fabric panel has a length that is substantially equal to a distance between associated vertical support posts;

wherein a physical characteristic of the filter fabric is that the filter fabric has an apparent opening size of about 0.60 mm or less; and an apron, wherein the apron comprises a blanket of filter fabric adapted to lay on the ground, wherein the apron is connected a bottom of the web of filter fabric connected to the vertical support posts, and further wherein the apron of filter fabric extends outwardly on the ground from the upstream vertical support posts.

2. The corrugated retention and filtration system as described in claim 1, further comprising:

wherein each vertical support post has a top portion proximate an end of the post that is above-ground;

and a first spacer cord that is fixedly attached to every second adjacent top portion of the plurality of vertical support posts, and the first spacer cord having a cord length;

wherein the first spacer cord length is less than the sum of the lengths of adjacent fabric filter panels between the vertical support posts attached to the first spacer cord; and a second spacer cord that is fixedly attached to a second adjacent top portion of the vertical support posts that are not attached to the first spacer cord.

3. The corrugated retention and filtration system as described in claim 2, wherein the length of the first spacer cord between every second adjacent vertical support post is substantially the same length.

4. The corrugated retention and filtration system as described in claim 2, wherein the length of the first spacer cord between every other vertical support post is substantially the same length, and further wherein the length of the second spacer cord between every other second adjacent vertical support post is substantially the same length.

5. The corrugated retention and filtration system as described in claim 1, wherein each adjacent filter fabric panel has substantially the same length.

6. The corrugated retention and filtration system as described in claim 1, wherein the adjacent filter fabric panels define an angle therebetween with the vertex of the angle being the vertical support post positioned between adjacent filter fabric panels.

7. The corrugated retention and filtration system as described in claim 6, wherein the angle formed by adjacent filter fabric panels is an acute angle.

8. The corrugated retention and filtration system as described in claim 1, further comprising:

overflow ports that are windows in the vertical filter fabric panels proximate downstream vertices formed by downstream vertical support posts and are positioned approximately half way up a vertical height of the downstream vertices.

9. A method of erecting a corrugated retention and filtration system on a work site, the method comprising the steps of:

providing a web of porous filter fabric connected to a plurality of three or more vertical support posts, wherein the web forms filter fabric panels between each adjacent pair of vertical support posts, and further wherein each filter fabric panel has a length that is substantially equal to a distance between adjacent vertical support posts and wherein a physical characteristic of the filter fabric is that the filter fabric has an apparent opening size of about 0.60 mm or less;

fixing the vertical support posts into the ground at a work site wherein adjacent filter fabric panels between the vertical support posts form an angle therebetween, and wherein the vertical support posts comprise in alternate position upstream and downstream vertical support posts adapted to be positioned on upstream and downstream sides of the system respectively;

providing an apron, wherein a apron comprises a blanket of filter fabric adapted to lay on the ground, connecting the apron to a base of the web of filter fabric connected to the vertical support posts, and further wherein the apron of filter fabric extends outwardly on the ground from upstream vertical support posts.

10. The method of erecting a corrugated retention and filtration system on a work site as described in claim 9, further comprising the steps of:

attaching a first spacer cord to a top portion of every second adjacent vertical support post, and wherein a first spacer cord length is less than the sum of the lengths of adjacent fabric filter panels between adjacent support posts attached to the first spacer cord.

11. The method of erecting a corrugated retention and filtration system on a work site as described in claim 10, wherein the length of the first spacer cord between every second adjacent vertical support post is substantially the same.

12. The method of erecting a corrugated retention and filtration system on a work site as described in claim 10, providing a second spacer cord and fixedly attaching the first spacer cord to a top portion of the vertical support posts that are not attached to the first spacer cord, wherein the length of the first spacer cord between every other vertical support post is substantially the same, and further wherein the length of the second spacer cord between every other second adjacent vertical support post is substantially the same.

13. The method of erecting a corrugated retention and filtration system on a work site as described in claim 9, further comprising the steps of:

wherein each adjacent filter fabric panel has substantially the same length.

14. The method of erecting a corrugated retention and filtration system on a work site as described in claim 9, further comprising the steps of:

wherein the angle formed by adjacent filter fabric panels is an acute angle.

* * * * *